US008311450B2

(12) United States Patent
Tanaka et al.

(10) Patent No.: US 8,311,450 B2
(45) Date of Patent: Nov. 13, 2012

(54) END COVER PART, METHOD OF PRODUCING THE SAME, IMAGE CARRIER, IMAGE FORMING ASSEMBLY, AND IMAGE FORMING APPARATUS

(75) Inventors: Kuniaki Tanaka, Ebina (JP); Tetsuto Chinen, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 240 days.

(21) Appl. No.: 12/814,907

(22) Filed: Jun. 14, 2010

(65) Prior Publication Data

US 2011/0142492 A1 Jun. 16, 2011

(30) Foreign Application Priority Data

Dec. 14, 2009 (JP) ..... 2009-283508

(51) Int. Cl.
*G03G 15/00* (2006.01)

(52) U.S. Cl. ..... 399/117; 29/895.23; 399/159; 492/47

(58) Field of Classification Search ..... 399/117, 399/116, 159, 107; 492/47; 29/895, 895.22, 29/895.23

See application file for complete search history.

(56) References Cited

U.S. PATENT DOCUMENTS

| | | | | |
|---|---|---|---|---|
| 3,550,231 | A * | 12/1970 | Rosenkranz et al. | 492/47 |
| 5,675,893 | A | 10/1997 | Yamada et al. | |
| 5,771,425 | A | 6/1998 | Yamada et al. | |
| 6,915,569 | B2 * | 7/2005 | Kolbe et al. | 29/895.23 |
| 2006/0239714 | A1 * | 10/2006 | Kweon et al. | 399/117 |
| 2007/0036580 | A1 * | 2/2007 | Noh | 399/117 X |

FOREIGN PATENT DOCUMENTS

| | | | |
|---|---|---|---|
| JP | 728292 | A | 1/1995 |
| JP | 3254833 | B2 | 11/2001 |

OTHER PUBLICATIONS

Office Action in counterpart Australian application No. 20102022572, dated Apr. 12, 2011.

* cited by examiner

*Primary Examiner* — Sophia S Chen
(74) *Attorney, Agent, or Firm* — Sughrue Mion, PLLC

(57) ABSTRACT

An end cover part which is used to close an end of a cylindrical body, and transmits a driving force of a rotatable driving shaft to the cylindrical body, includes a cover member having a tubular portion into which the driving shaft is to be fitted, and a to-be-fitted portion which is disposed in a flange-like manner in a periphery of the tubular portion, and which is to be fitted into an end portion of the cylindrical body; cut surfaces which are disposed respectively on an inner circumference of the tubular portion of the cover member and an outer circumference of the to-be-fitted portion and concentrically about a common reference central axis; and a recess as defined herein.

15 Claims, 24 Drawing Sheets

END COVER PART, METHOD OF PRODUCING THE SAME, IMAGE CARRIER, IMAGE FORMING ASSEMBLY, AND IMAGE FORMING APPARATUS

CROSS-REFERENCE TO RELATED APPLICATIONS

This application is based on and claims priority under 35 USC 119 from Japanese Patent Application No. 2009-283508 filed on Dec. 14, 2009.

BACKGROUND

Technical Field

The present invention relates to an end cover part, a method of producing the same, an image carrier, an image forming assembly, and an image forming apparatus.

SUMMARY

According to an aspect of the invention, there is provided an end cover part which is used to close an end of a cylindrical body, and transmits a driving force of a rotatable driving shaft to the cylindrical body, the end cover part including: a cover member having a tubular portion into which the driving shaft is to be fitted, and a to-be-fitted portion which is disposed in a flange-like manner in a periphery of the tubular portion, and which is to be fitted into an end portion of the cylindrical body; cut surfaces which are disposed respectively on an inner circumference of the tubular portion of the cover member, and an outer circumference of the to-be-fitted portion, and concentrically about a common reference central axis; and a recess which is disposed so as to ensure a gap between the inner circumference of the tubular portion and the driving shaft in a place of the inner circumference of the tubular portion adjacent to the cut surface of the inner circumference and corresponding to a portion on which an external force acts from the radially outer side of the tubular portion on an outer circumference of the tubular portion.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1 . . . image carrier, 2 . . . cylindrical body, 3 (3*a*, 3*b*) . . . end cover part, 4 . . . driving shaft, 5 . . . cover member, 6 . . . tubular portion, 7 . . . to be fitted portion, 7*a* . . . guide surface, 8 . . . reference central axis, 9 (9*a* to 9*c*) . . . cut surface, 10 . . . functional member, 11 . . . charging device, 12 . . . developing device, 13 . . . transferring device, 14 . . . cleaning device, 15 . . . transfer medium, 16 . . . bearing member, 17 . . .

positioning member, 18 . . . to-be-positioned member, 19 . . . grasping jig, 20 (20*a* to 20*c*) . . . cutting tool, 21 (21*a*, 21*b*) . . . recess

DETAILED DESCRIPTION

Summary of Exemplary Embodiment

Figure 1A:
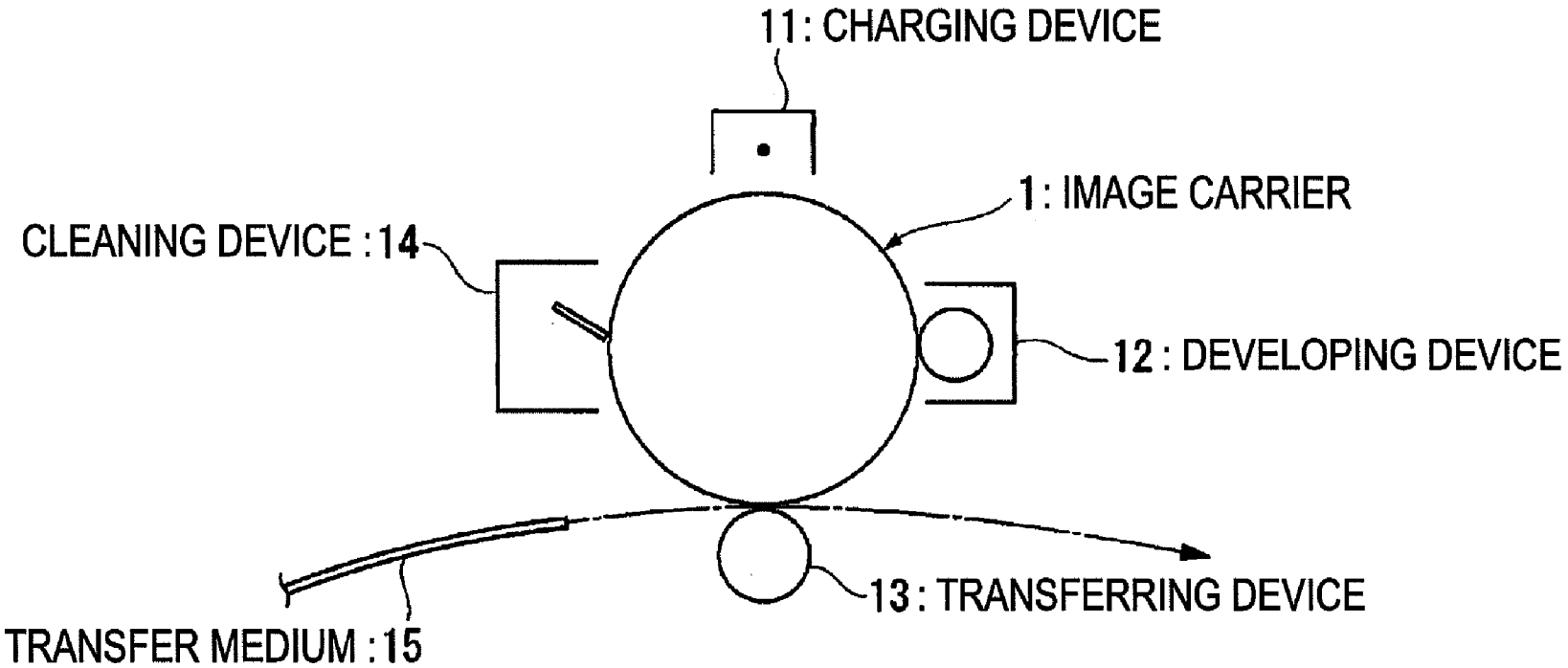
FIG. 1A is a diagram schematically showing an exemplary embodiment of an image forming apparatus to which the invention is applied.

FIG. 1A shows an exemplary embodiment of an image forming apparatus to which the invention is applied.

Referring to the figure, for example, the image forming apparatus includes: an image carrier 1 which holds an image; a developing device 12 which visualizes an electrostatic latent image formed on the image carrier 1, by means of a developer; a transferring device 13 which transfers the image visualized by the developing device 12, to a transfer medium 15; and a cleaning device 14 which cleans a residual developer that, after the transferring by the transferring device 13, remains on the image carrier 1.

The image carrier 1 may be single. Alternatively, a plurality of image carriers may be disposed respectively for a plurality of color components, or commonly for a part of the color components.

In an example where the image carrier 1 is a photosensitive member, a charging device 11 which charges the image carrier 1, and a latent image writing device which writes an electrostatic latent image on the charged image carrier 1 by means of light may be used as a latent image forming element which forms an electrostatic latent image on the image carrier 1. In a case where the image carrier 1 is a dielectric member, the charging device 11 which charges the image carrier 1, and a latent image writing device which writes an electrostatic latent image on the charged image carrier 1 by means of ions may be used. In a further case where the image carrier has a form in which pixel electrodes are arranged in a matrix on a movable support member, a latent image voltage corresponding to an image signal is applied to each of the pixel electrodes to form an electrostatic latent image.

The transfer medium 15 may be of course a final medium such as a recording member, or alternatively an intermediate transferring member to which an image is temporarily transferred before the image is transferred to a recording member.

Figure 1B:
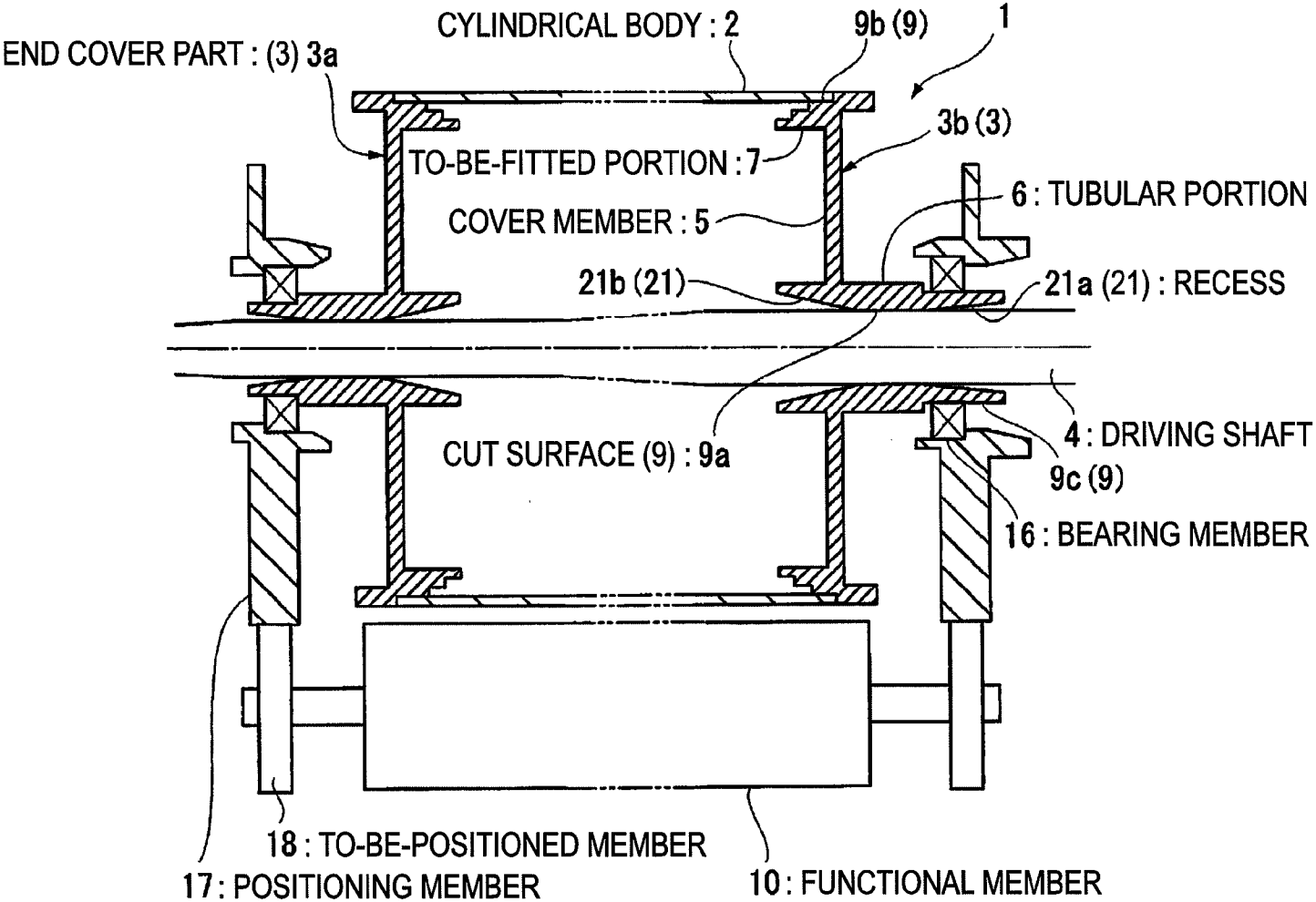
FIG. 1B is a diagram schematically showing an image carrier and end cover parts that are used in FIG. 1A.

In the exemplary embodiment, as shown in FIG. 1B, particularly, the image carrier 1 includes a cylindrical body 2 which can hold an image, and end cover parts 3 which close the both ends of the cylindrical body 2, and which transmit a driving force of a rotatable driving shaft 4 to the cylindrical body 2. Each of the end cover parts 3 includes: a cover member 5 having a tubular portion 6 into which the driving shaft 4 is fitted, and a to-be-fitted portion 7 which is disposed in a flange- or eave-like manner in the periphery of the tubular portion 6, and which is fitted into an end portion of the cylindrical body 2; cut surfaces 9 (for example, 9*a*, 9*b*) which are disposed on the inner circumference of the tubular portion 6 of the cover member 5 and the outer circumference of the to-be-fitted portion 7, and concentrically about a common reference central axis 8 (see FIG. 2); and recesses 21 (for example, 21*a*, 21*b*) which are disposed so as to ensure gaps between the inner circumference of the tubular portion 6 and the driving shaft 4 in places of the inner circumference of the tubular portion 6 adjacent to the cut surface 9*a* of the inner circumference and corresponding to portions on which external forces act from the radially outer side of the tubular portion 6 on the outer circumference.

The material of the cover member 5 may be adequately selected. From the viewpoint of suppressing deformation of the end cover part 3 in a usual use state, a glass fiber filled synthetic resin (for example, glass fiber filled polycarbonate) is preferred.

The cut surface 9*a* which is formed on the inner circumference of the tubular portion 6 is formed in a dimension which enables clearance-fitting to the driving shaft 4, and the cut surface 9*b* which is disposed on the outer circumference of the to-be-fitted portion 7 is formed so as to be interference-fitted to the inner circumferential surface of the cylindrical body 2.

On the outer circumference of the to-be-fitted portion 7, an adhesive agent applying surface which is smaller in diameter than the cut surface 9*b* may be disposed on the tip end side with respect to the cut surface 9*b*, or, from the viewpoint of smoothly fitting the to-be-fitted portion 7 to the cylindrical body 2, a guide surface 7*a* which is smaller in diameter than the cut surface 9*b* may be disposed as a guide in the fitting into the cylindrical body 2, on the tip end side with respect to the cut surface which is disposed on the outer circumference of the to-be-fitted portion 7.

As shown in FIG. 1B, the cut surface 9 (for example, 9*c*) may be further formed on the outer circumference of the tubular portion 6. The thus formed cut surface 9*c* is used as a positioning reference plane for positioning a functional member 10 (see FIG. 1B) which is disposed in the periphery of the image carrier 1. For example, the cut surface 9*c* which is disposed on the outer circumference of the tubular portion 6 functions as a positioning reference plane having a positioning structure in which a positioning member 17 is placed through a bearing member 16, and a to-be-positioned member 18 that is disposed on the side of the functional member 10 is butted against the positioning member 17.

It is necessary to dispose at least one recess 21 (for example, 21*a* or 21*b*). Preferably, the recess is disposed along the inner circumference of the tubular portion 6.

A typical example of placement of the recess 21 will be described. In a configuration where a cut surface 9 (for example, 9*c*) centered at the common reference central axis 8 (see FIG. 2) is disposed also on the outer circumference of the tubular portion 6, and the cut surface 9*c* is used as a positioning reference plane for positioning the functional member 10 which is disposed in the periphery of the cylindrical body 2, the recess 21 (for example, 21*a*) is disposed on the inner circumference of the tubular portion 6 corresponding to the portion of the cut surface 9*c* (functioning as the positioning reference plane) on which the external force acts from the radially outer side of the tubular portion 6.

In another typical example of placement of the recess 21, the recess 21 (for example, 21*b*) is disposed on the inner circumference of the tubular portion 6 corresponding to a portion of the cover member 5 where is a portion on which an external force acts from the radially outer side of the tubular portion 6, and where the to-be-fitted portion 7 and the tubular portion 6 are coupled with each other.

When considering the insertion property of the driving shaft 4, a typical shape of the recess 21 is preferably formed as an inclined portion in which the inner circumferential section shape of the tubular portion 6 is expanded as advancing toward the end of the tubular portion 6.

In a further preferred configuration of the recess 21, the recess is disposed on the inner circumference of the tubular portion 6 corresponding to the whole region of the portion of the outer circumference of the tubular portion 6 on which an external force acts from the radially outer side of the tubular portion 6. In the case where the recess 21 is disposed on the inner circumference of the tubular portion 6 corresponding to the whole range of the external-force acting portion as described above, even when an excess radial load is applied to the external-force acting portion, an external force due to the load is absorbed by the recess 21 to be little transmitted to the driving shaft 4.

Figure 2:
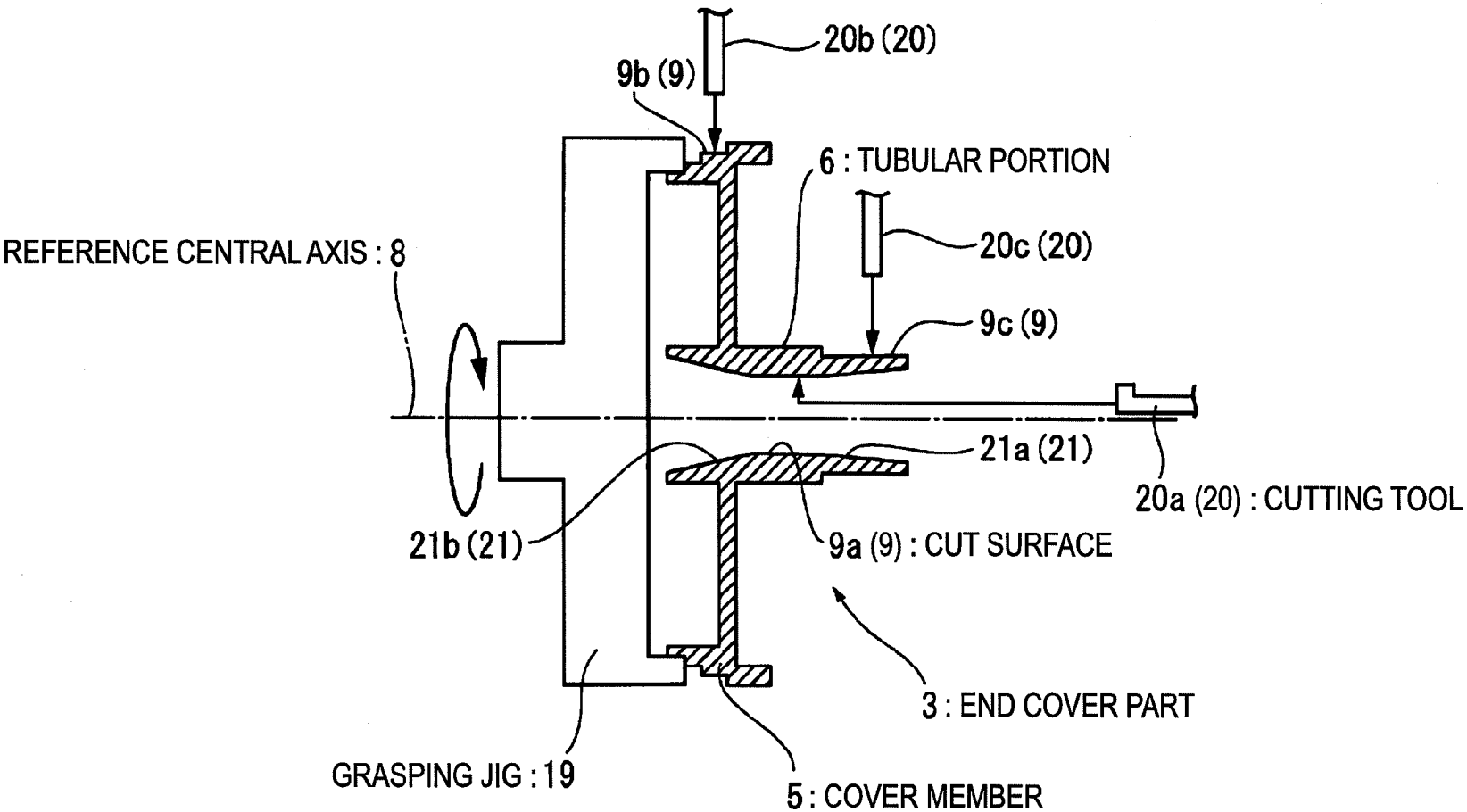
FIG. 2 is a diagram showing a typical method of producing the end cover part shown in FIGS. 1A and 1B.

In the exemplary embodiment, for example, each of the end cover part 3 may be produced in the following method. As shown in FIG. 2, for example, after the cover member 5 is die-molded so that the recesses 21 (for example, 21*a*, 21*b*) are formed in predetermined portions of the inner circumference of the tubular portion 6, the die-molded cover member 5 is grasped by a grasping jig 19 so as to be rotatable about the common reference central axis 8, and then the cut surfaces (in the exemplary embodiment, 9*a* to 9*c*) are sequentially formed by cutting tools 20 (in the exemplary embodiment, 20*a* to 20*c*) on the place where the cut surfaces are to be formed, and where the inner circumference of the tubular portion 6 of the cover member 5 and the outer circumference of the to-be-fitted portion 7 are included (in the exemplary embodiment, also the outer circumference of the tubular portion 6 is included, but a configuration where it is not included may be possible).

From the viewpoint that the roundness of the end cover part 3 is made accurate, particularly, a wider portion of the end cover part 3 is preferably grasped in order to improve the accuracy of centering by the grasping jig 19. For example, preferably, the grasping jig 19 grasps a portion of the cover member 5 on the tip end side with respect to the place of the to-be-fitted portion 7 of the cover member 5 where the cut surfaces are to be formed, and, on the inner and outer circumferences of the tubular portion 6 and the outer circumference of the to-be-fitted portion 7, the cut surfaces 9 (9*a* to 9*c*) are formed by the cutting tools 20 (20*a* to 20*c*) while the cover member 5 is grasped by the grasping jig 19 and kept not to be separated therefrom.

The pair of end cover parts 3 (3*a*, 3*b*) which close the both ends of the cylindrical body 2 may be fitted into the cylindrical body 2 with any positional relationship. From the viewpoint that the rotation accuracy of the cylindrical body 2 is maintained more satisfactorily, preferably, they close the both ends of the cylindrical body 2 with an angular relationship in which the eccentricity amount in the rotation of the cylindrical body 2 with respect to the reference position is not increased.

Furthermore, the above-described image carrier 1 may be singly used in the image forming apparatus, or may be used as an image forming assembly.

The image forming assembly may include at least the above-described image carrier 1, and the developing device 12 which visualizes an electrostatic latent image held on the image carrier 1, by means of a developer, and these devices may be incorporated in a common case member (not shown).

The common case member may of course have a configuration in which the member is single, or may include a configuration where a plurality of case members are correlatingly integrated with one another.

In a typical image forming assembly, for example, the developing device 12 is pressed toward the image carrier 1, and uses the cut surfaces 9*c* disposed on the outer circumferences of the tubular portions 6 of the end cover parts 3, as positioning reference planes, the positioning members 17 are disposed through the bearing members 16 with respect to the positioning reference planes on the sides of the end cover parts 3, and the to-be-positioned members 18 which butt against the positioning members 17 are disposed on the side of the developing device 12.

In another typical configuration of the image forming assembly, the case member is positioned with reference to the cut surfaces 9 (for example, 9*c*) of the end cover parts 3, and a charging device positioning portion (not shown) which can position the charging device 11 for charging the image carrier 1 may be disposed in the case member.

Also in an image forming apparatus having a configuration in which the image carrier 1 is not incorporated in the image forming assembly, by contrast, the image carrier 1 and the developing device 12 may use the cut surfaces 9*c* disposed on the outer circumferences of the tubular portions 6 of the end cover parts 3, as positioning reference planes, the positioning members 17 may be disposed through the bearing members 16 on the positioning reference planes on the side of the end cover parts 3, and the to-be-positioned members 18 which butt against the positioning members 17 may be disposed on the side of the developing device 12.

In an image forming apparatus having a configuration including the charging device 11 for charging the image carrier 1, the charging device 11 may use the cut surfaces 9*c* disposed on the outer circumferences of the tubular portions 6 of the end cover parts 3, as positioning reference planes, and a positioning portion against which a to-be-positioned portion of the charging device 11 butts may be disposed on a member (for example, the case member) which is positioned to the positioning reference planes.

From the viewpoint that, irrespective of whether the image carrier 1 is incorporated in the image forming assembly or not, the accuracy of the position of the image carrier 1 is maintained to a high level, in a configuration of the image forming apparatus in which a cleaning device 14 that cleans the image carrier 1 is disposed, preferably, the cleaning device 14 has a plate-like cleaning member which is pressingly contacted with the image carrier 1, and the image carrier 1 is shifted to one side in a predetermined direction.

Although, in Summary of exemplary embodiment, the end cover parts 3 which close the both ends of the image carrier 1 used in the image forming apparatus have been described, the invention is not restricted to this. The invention may be applied also to the end cover parts 3 which close the both ends of the cylindrical body 2 that does not hold an image.

Exemplary Embodiment 1

Whole Configuration of Image Forming Apparatus

Figure 3:
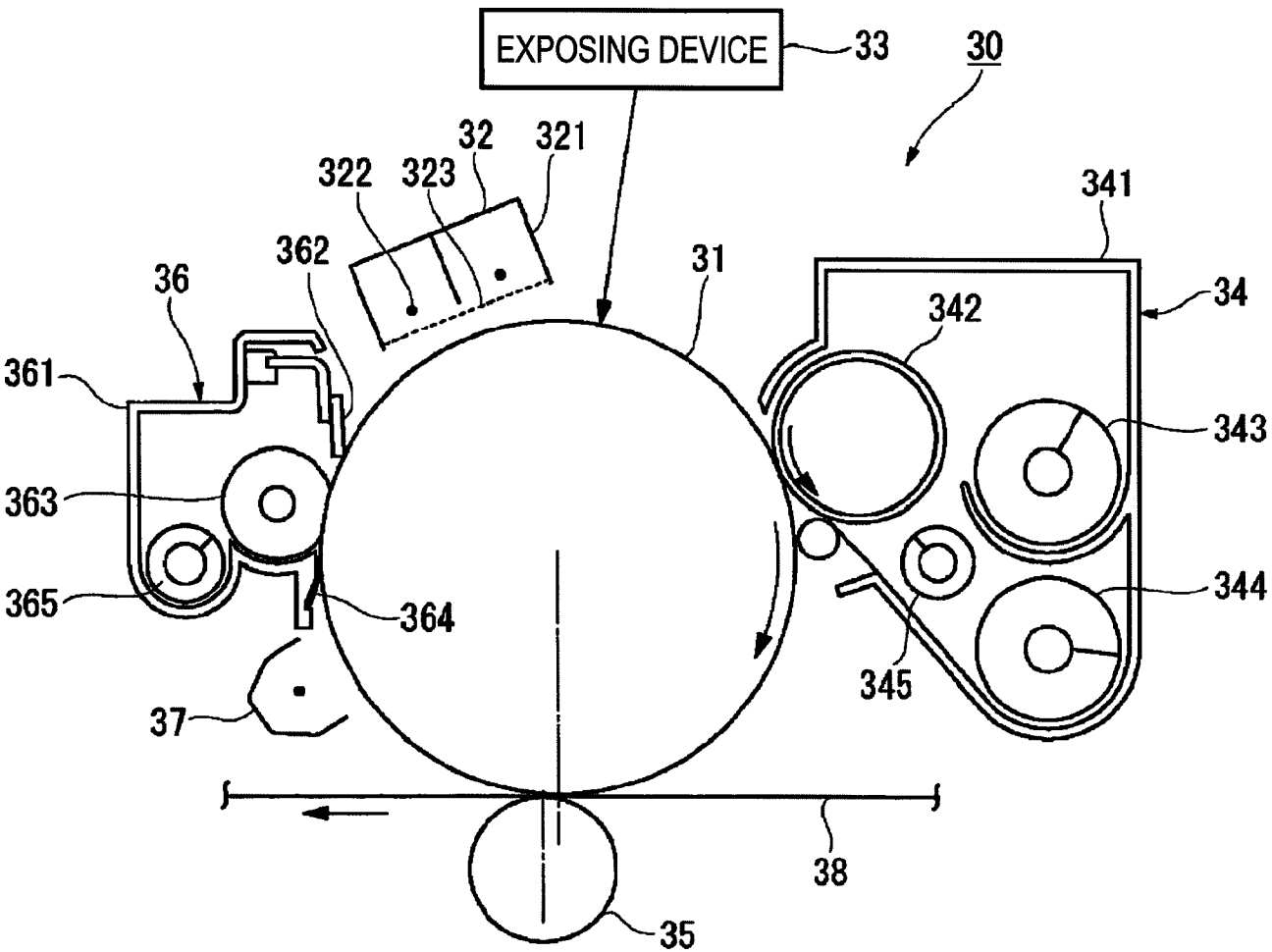
FIG. 3 is a diagram showing the whole configuration of the image forming apparatus of Exemplary embodiment 1.

FIG. 3 shows the whole configuration of an image forming apparatus of Exemplary embodiment 1.

Referring to the figure, the image forming apparatus 30 includes: a drum-like photosensitive member 31 which functions as an image carrier; a charging device 32 which charges the photosensitive member 31; an exposing device 33 which writes an electrostatic latent image by means of light on the photosensitive member 31 that is charged by the charging device 32; a developing device 34 which visualizes the electrostatic latent image written on the photosensitive member 31, by means of a developer (toner); a transferring device 35 which transfers the image that is visualized by the developing device 34, to a recording member 38; a cleaning device 36 which cleans away a residual developer that, after the transfer process is performed by the transferring device 35, remains on the photosensitive member 31; and a charge adjusting device 37 which is opposed to the photosensitive member 31 positioned between the cleaning device 36 and the transferring device 35, and which adjusts the charge polarity of the residual developer to the original one. The transferred image transferred to the recording member 38 is fixed by a fixing device which is not shown, and then discharged.

Figure 7:
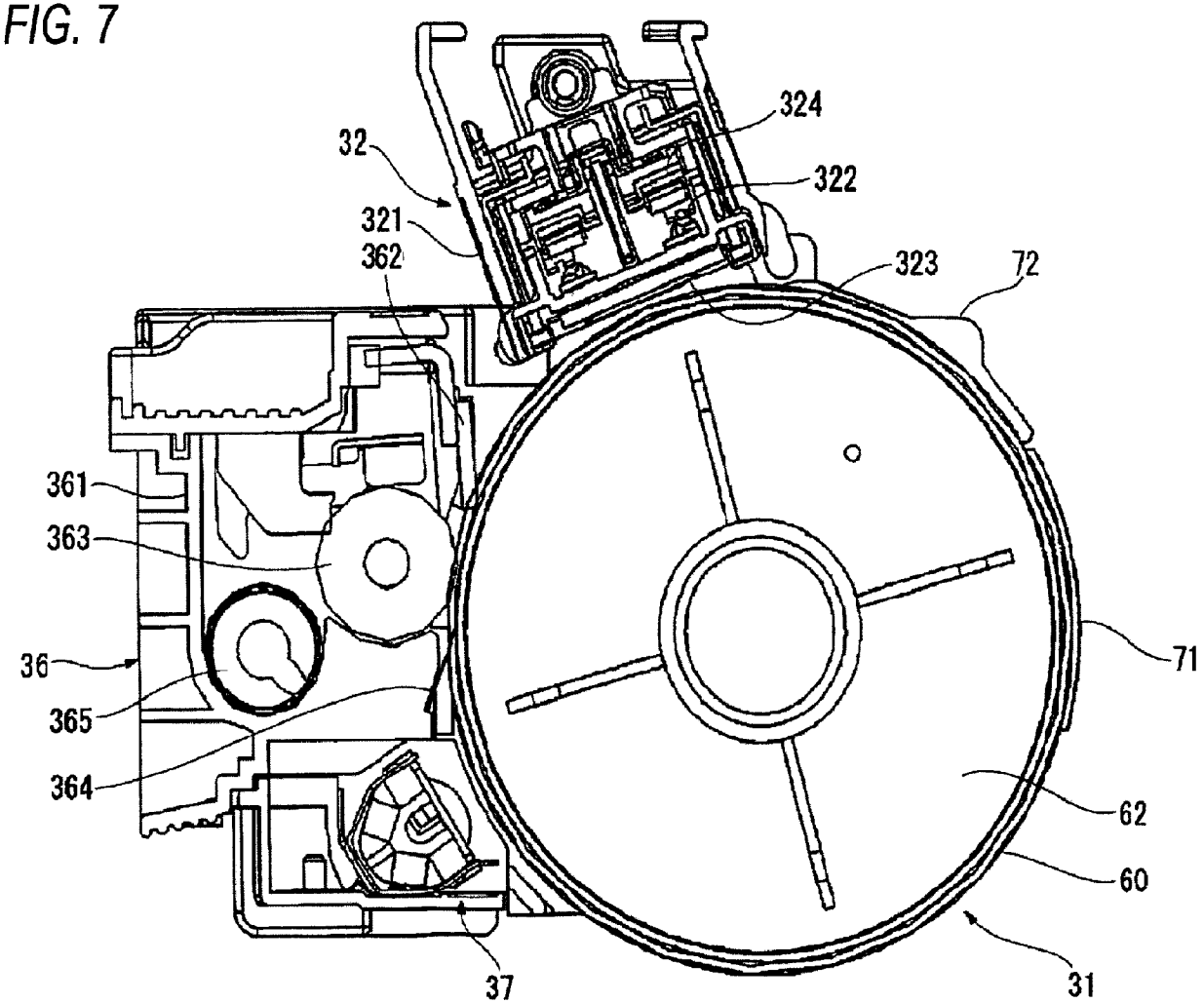
FIG. 7 is a sectional diagram of FIG. 6.

For example, the charging device 32 has a charging container 321, and charging wires 322 and a grid electrode 323 are disposed as charging members in the charging container 321. The charging device also has cleaning tools 324 (see FIG. 7) which periodically clean the charging wires 322. The charging device 32 is not restricted to this, and may be adequately selected. For example, roll-like charging members may be used.

The developing device 34 has a developing container 341 which is opened in the side of the photosensitive member 31, and which houses a two-component developer containing a toner and a carrier. A developing roll 342 which can hold and convey the developer is placed in a place of the developing container 341 which is opposed to the photosensitive member 31. In the developing container 341, on the side of the back face of the developing roll 342, stirring and conveying members 343, 344 which stir and convey the developer in order to frictionally charge the toner are disposed, for example, in a vertically manner. The developer which is stirred and conveyed by the stirring and conveying members 343, 344 is passed to the developing roll 342 through an auxiliary conveying member 345. The developer which is held on the developing roll 342 is subjected to layer thickness regulation by a layer thickness restricting member (not shown), and then supplied to the developing region opposed to the photosensitive member 31. The developing device 34 is not limited to have the above-described two-component developer system, and may be adequately selected to have any system such as the one-component developer system.

The cleaning device 36 has a cleaning container 361 which is opened in the side of the photosensitive member 31, and which houses the residual developer. In the opening of the cleaning container 361, a plate-like cleaning member 362 such as a blade or a scraper is disposed on the downstream edge in the rotation direction of the photosensitive member 31, a brush- or roll-like rotary cleaning member 363 is disposed upstream from the plate-like cleaning member 362 in the rotation direction of the photosensitive member 31, and a sealing member 364 for sealing is disposed on the upstream edge in the rotation direction of the photosensitive member 31, in the opening of the cleaning container 361. Furthermore, a recovery conveying member 365 for discarding a cleaned waste developer is disposed in the cleaning container 361. Also the cleaning device 36 is not limited to this, and may be adequately selected.

—Image Forming Assembly—

In the exemplary embodiment, the image forming apparatus 30 has an image forming assembly 40 which is detachable with respect to an apparatus case (not shown).

Figure 4:
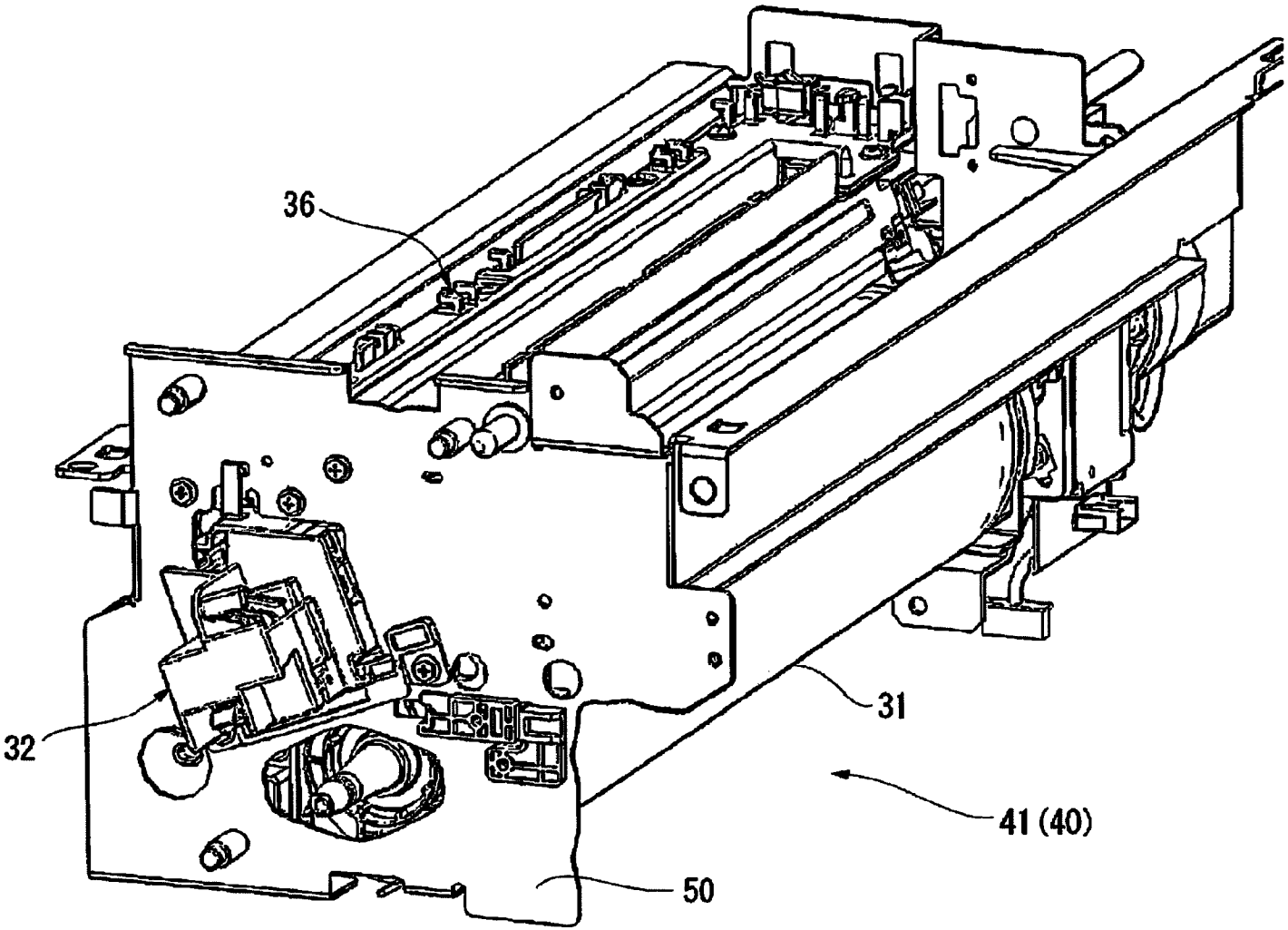
FIG. 4 is a perspective diagram showing the whole configuration of a photosensitive member assembly used in Exemplary embodiment 1.
Figure 5:
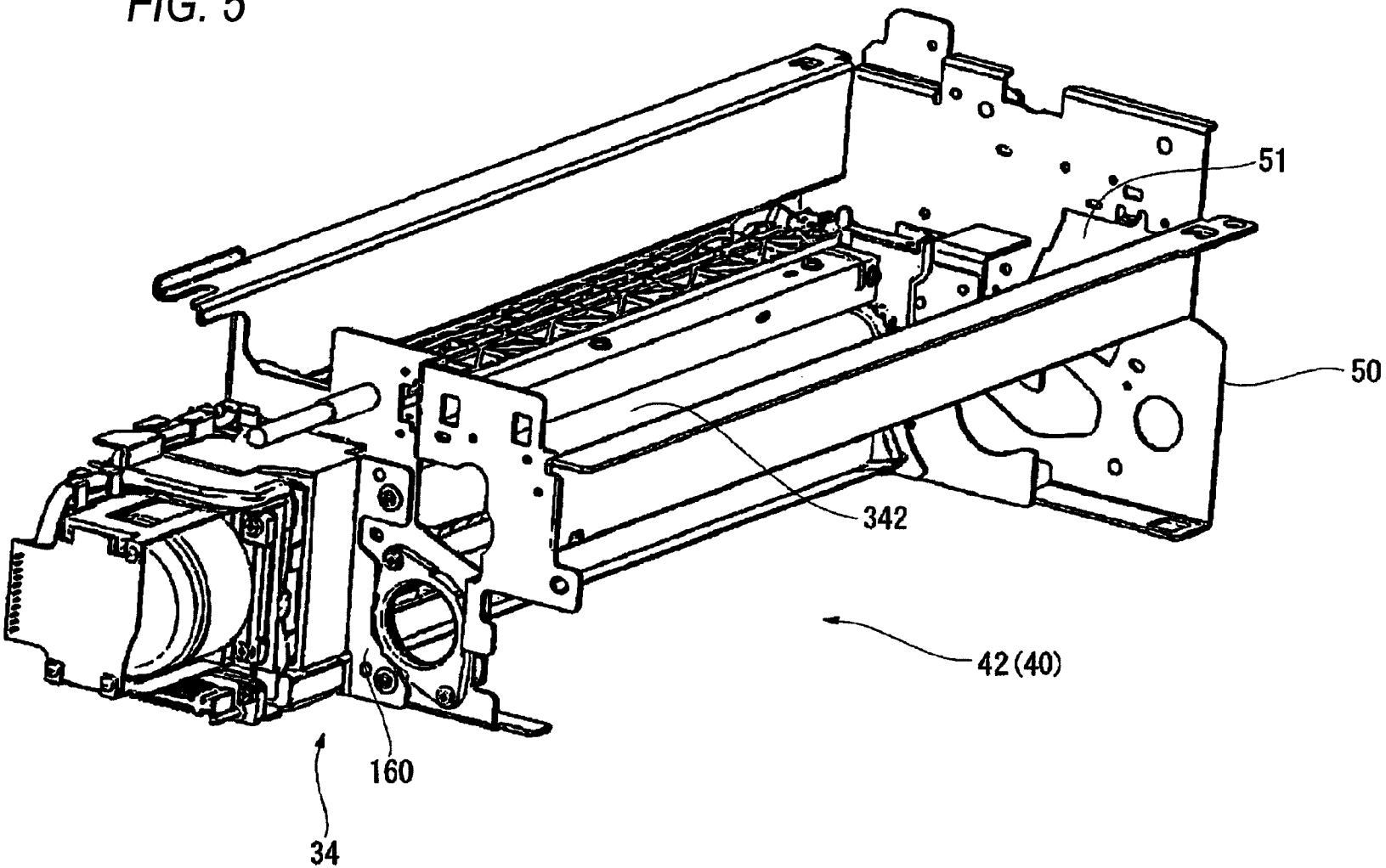
FIG. 5 is a perspective diagram showing the whole configuration of a developing assembly used in Exemplary embodiment 1.
Figure 6:
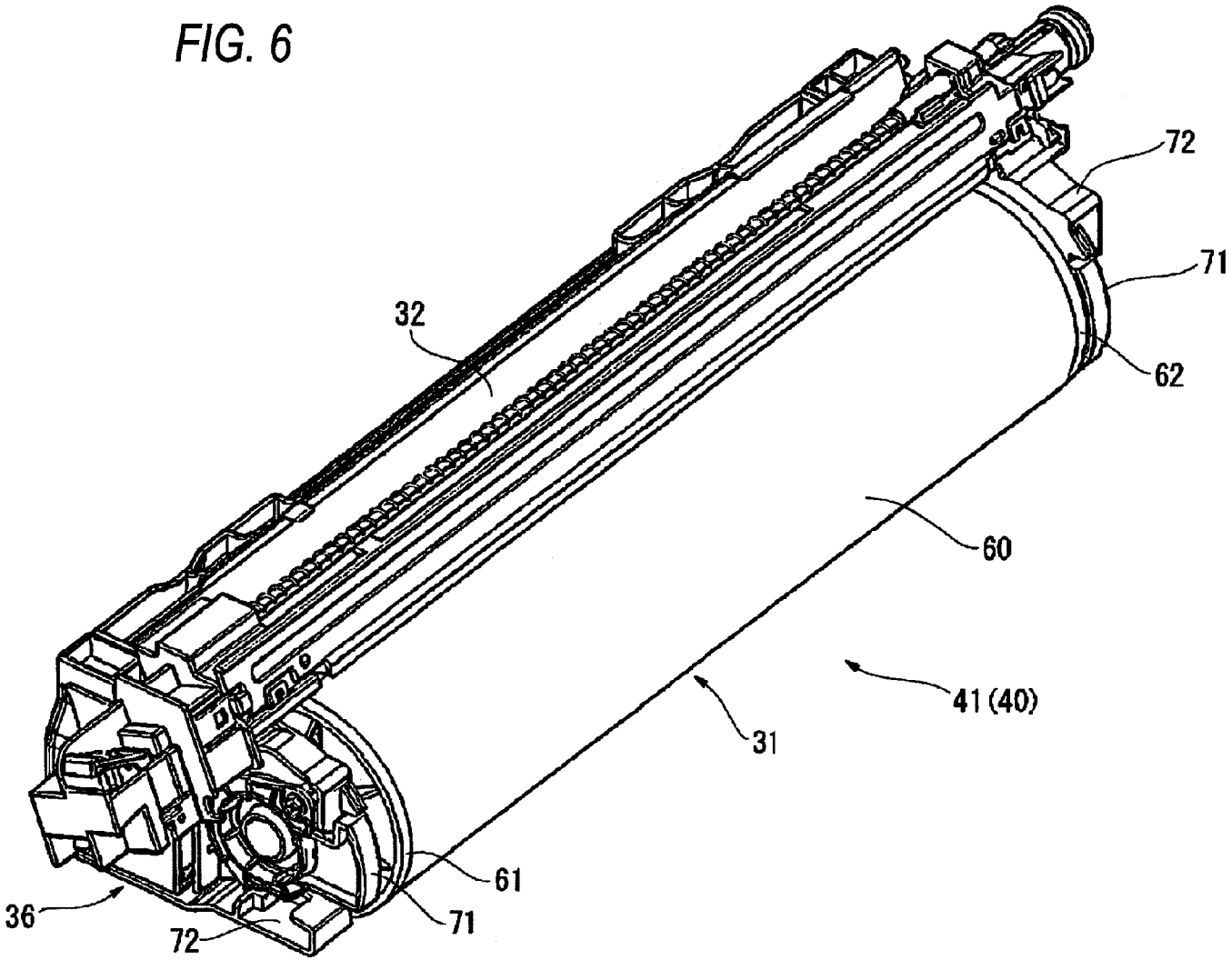
FIG. 6 is a perspective diagram showing main portions of the photosensitive member assembly used in Exemplary embodiment 1.

The image forming assembly 40 has a photosensitive member assembly (photosensitive member unit) 41 shown in FIG. 4, and a developing assembly (developing unit) 42 which is incorporated in state where it is pressed against the photosensitive member assembly 41, and which is shown in FIG. 5.

<Photosensitive Member Assembly>

In the photosensitive member assembly 41, as shown in 4 and 6 to 9, the charging device 32, the charge adjusting device 37, and the cleaning device 36 are arranged in the periphery of the photosensitive member 31, and supported by a supporting frame 50. The reference numeral 51 (see FIG. 5) denotes an insertion port which is opened in the supporting frame 50 so as to allow the charging device 32 to be inserted into the photosensitive member assembly 41.

Figure 12A:
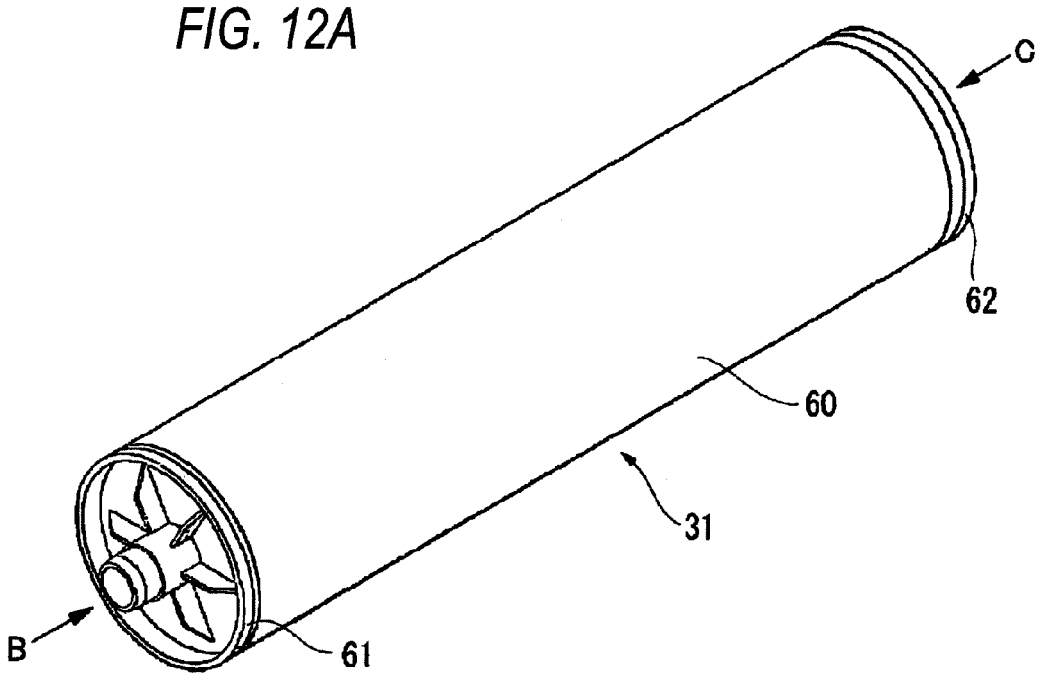
FIG. 12A is a perspective diagram showing the photosensitive member used in Exemplary embodiment 1.
Figure 12B:
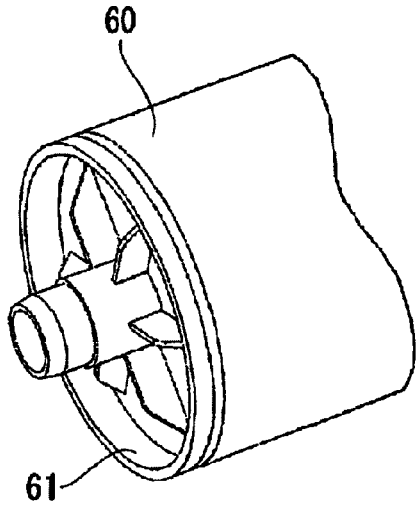
FIG. 12B is a view looking in the direction of the arrow B in FIG. 12A.
Figure 12C:
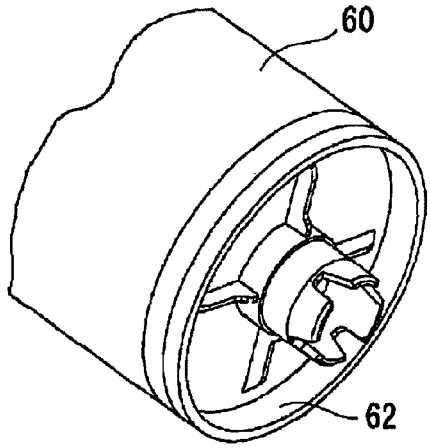
FIG. 12C is a view looking in the direction of the arrow C in FIG. 12A.

As shown in FIGS. 12A to 12C, the photosensitive member 31 includes: a photosensitive drum 60 that is a cylindrical body in which a photosensitive layer is formed in the surface; a pair of flanges 61, 62 functioning as end cover parts which close the both ends of the photosensitive drum 60; and a driving shaft 63 (see FIGS. 16 to 18) which transmits a rotation driving force to the photosensitive drum 60 through the flanges 61, 62.

Figure 10:
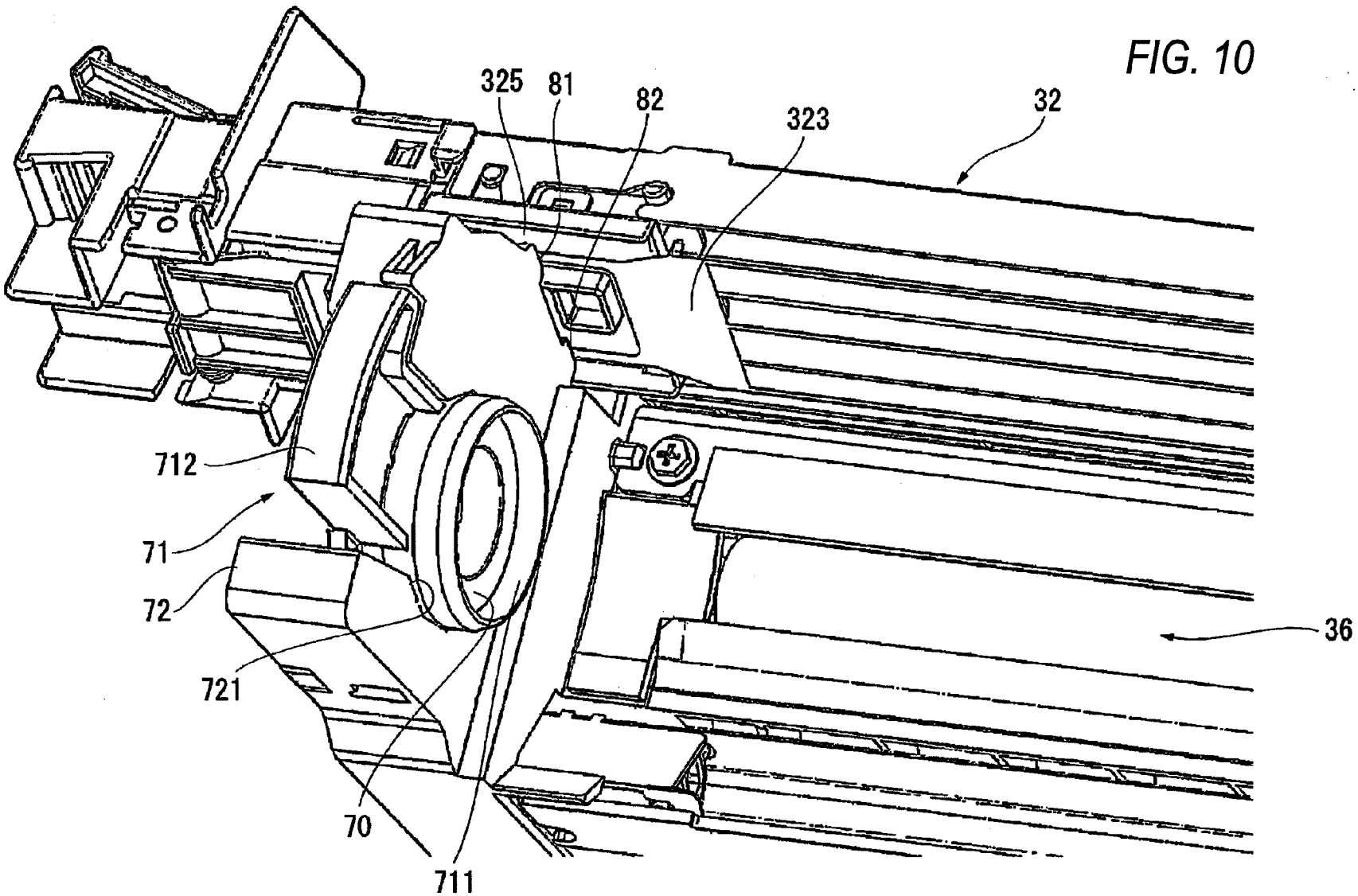
FIG. 10 is a perspective diagram showing an example of a positioning structure between a photosensitive member and the charging device in an end side of the photosensitive member.
Figure 11:
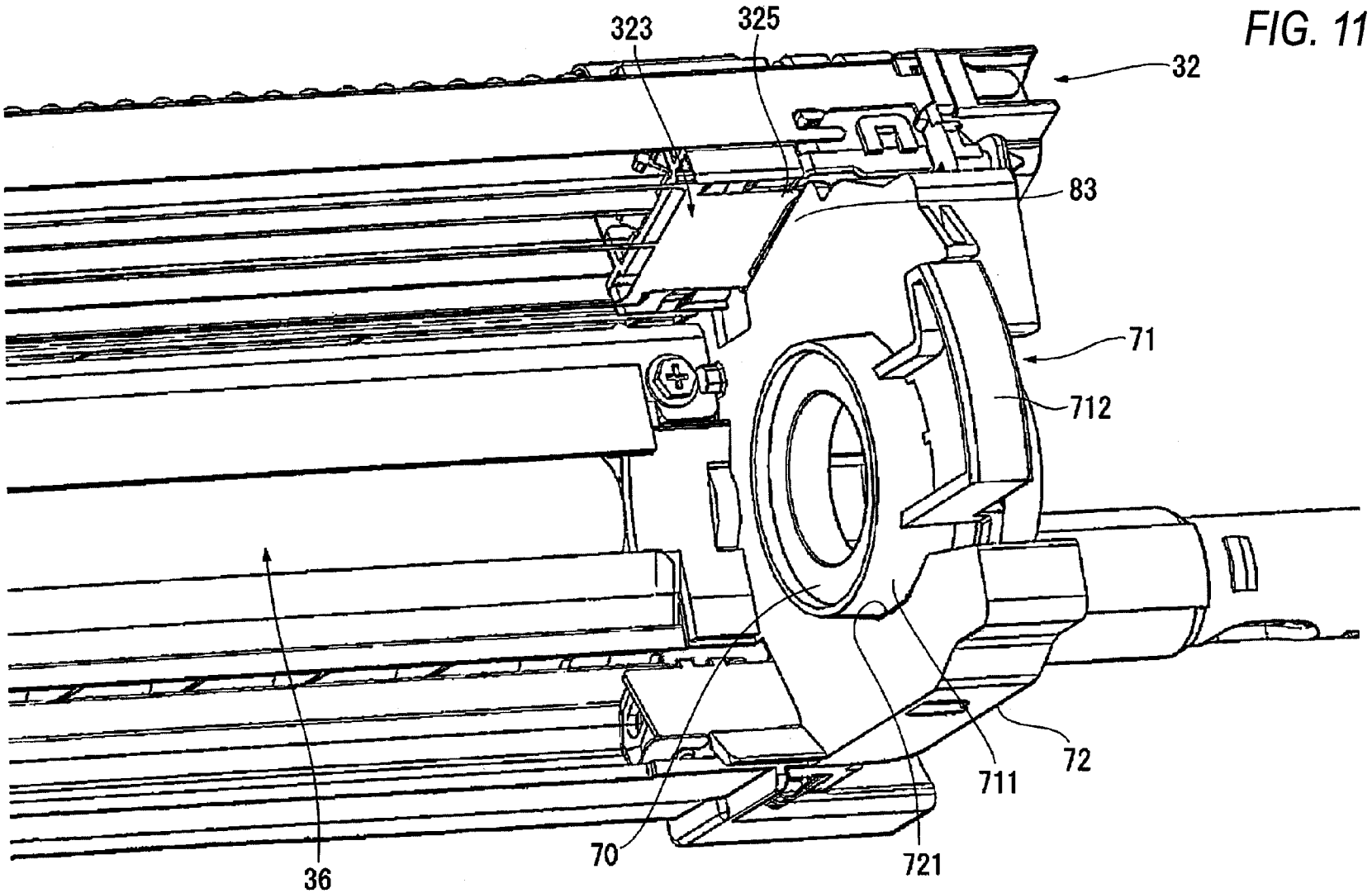
FIG. 11 is a perspective diagram showing an example of a positioning structure between the photosensitive member and the charging device in the other end side of the photosensitive member.

In the exemplary embodiment, as shown in FIGS. 10 and 11, bearing members 70 are disposed in places corresponding to the pair of flanges 61, 62, and developing positioning members 71 are rotatably disposed on the outer circumferences of the bearing members 70. Each of the developing positioning members 71 has an annular portion 711 which is fitted to an outer circumferential portion of the corresponding bearing member 70, and a projecting piece 712 which is radially projected by a predetermined dimension toward the developing roll 342 of the developing device 34 is disposed on the annular portion 711.

In the exemplary embodiment, case members 72 which respectively support both end portions of the photosensitive member 31 are disposed, and each of the case members 72 has a substantially C-like receiving portion 721 which surrounds the annular portion 711 of the corresponding developing positioning member 71.

Figure 8:
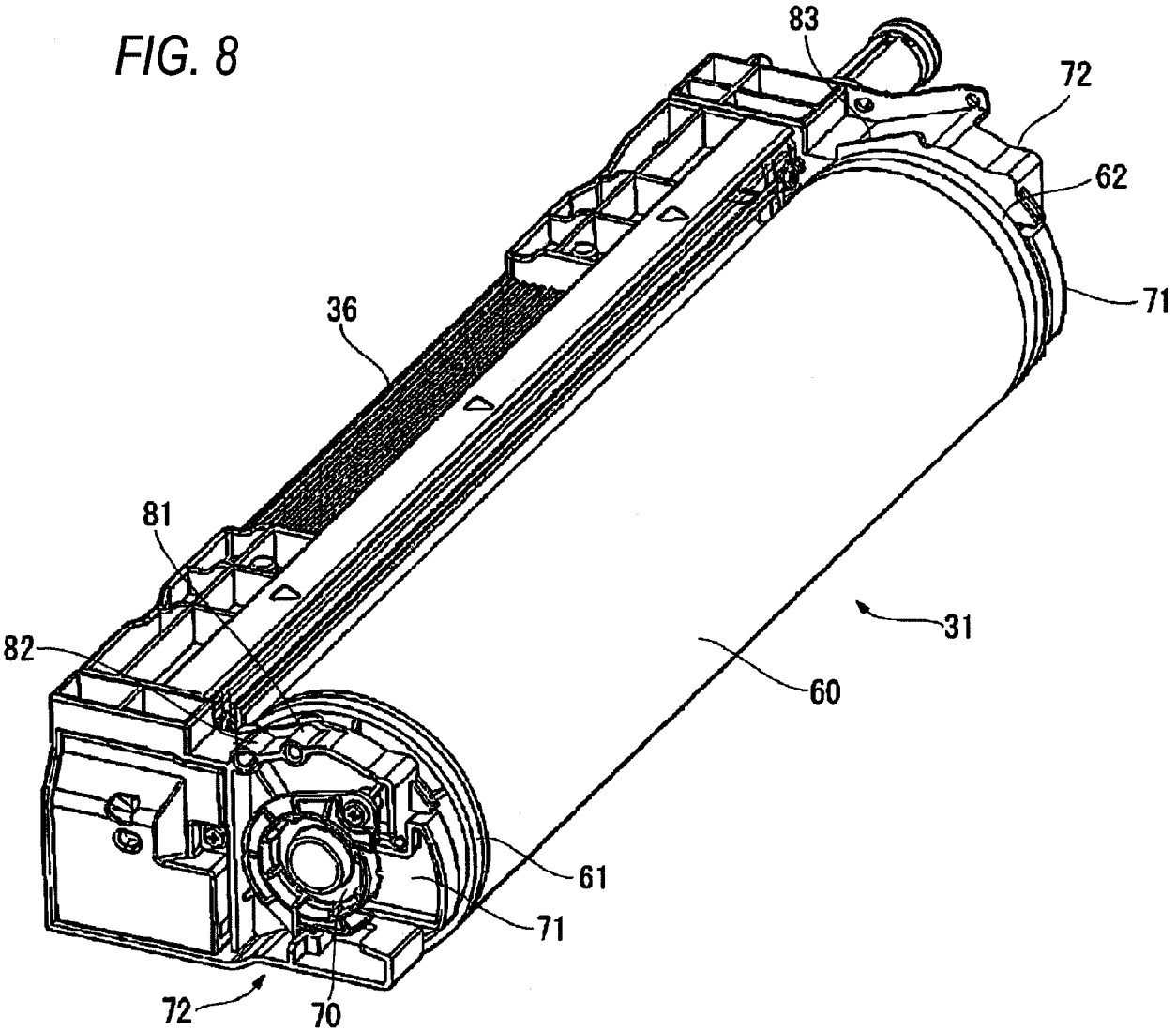
FIG. 8 is a perspective diagram showing a state where a charging device is removed away from the photosensitive member assembly.
Figure 9:
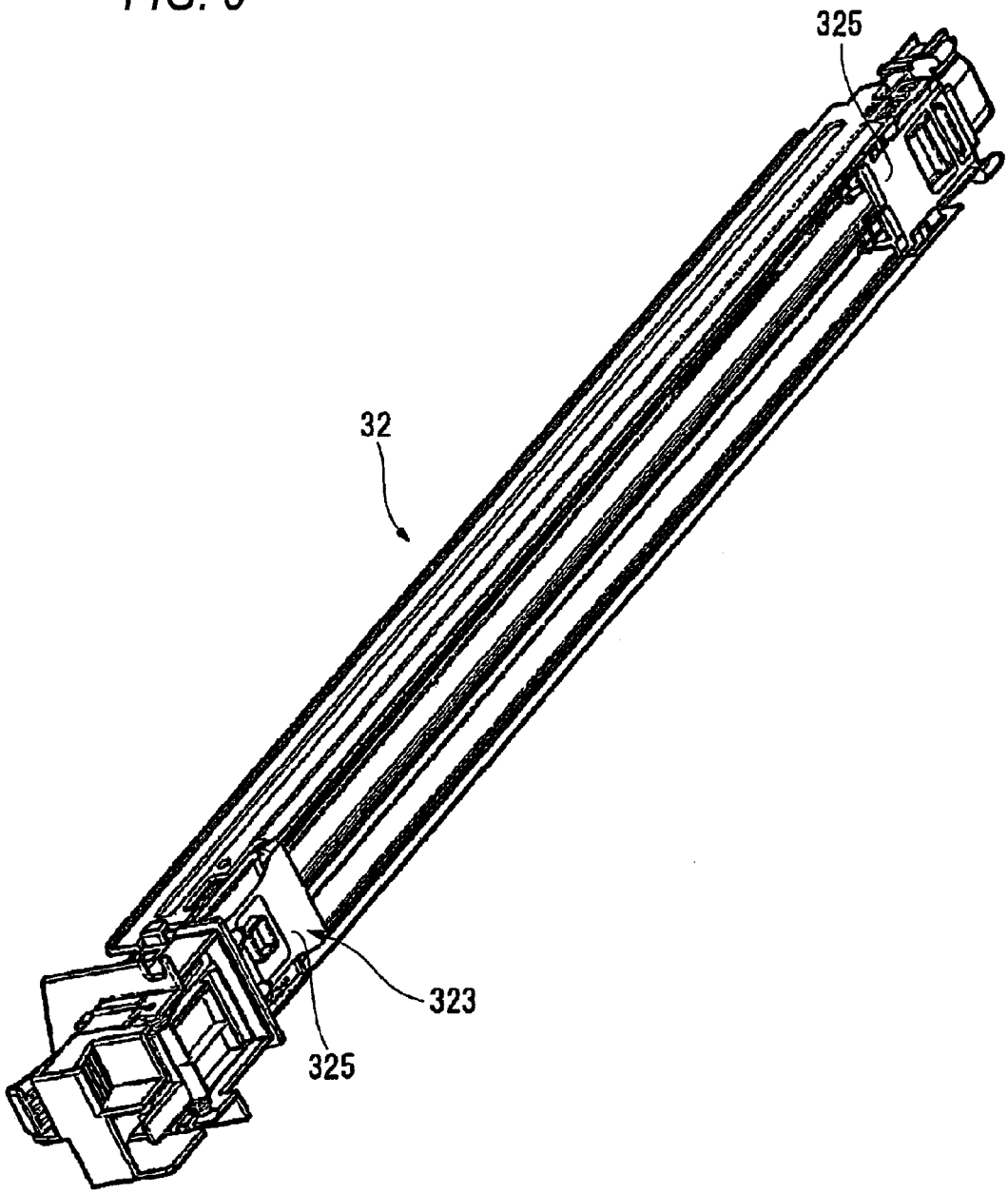
FIG. 9 is a perspective diagram showing the charging device which is an element of the photosensitive member assembly.

In portions of each of the case members 72 opposed to the charging device 32, as shown in FIGS. 8, 10, and 11, positioning protrusions 81 to 83 are integrally formed. The positioning protrusions butt against to-be-positioned portions 325 configured by end supporting portions of the grid electrode 323 of the charging device 32, whereby the relative positional relationships between the photosensitive member 31 and the charging wires 322 and grid electrode 323 of the charging device 32 are positioned.

In the exemplary embodiment, the three positioning protrusions 81 to 83 are disposed. Alternatively, one positioning protrusion may be disposed in each of the both longitudinal ends of the charging device 32.

<Flange Configuration>

In the exemplary embodiment, each of the flanges 61, 62 which close the both ends of the photosensitive member 31 includes a cover member 100 which is die-molded by a glass fiber filled synthetic resin (for example, glass fiber filled polycarbonate), and which is then subjected to a cutting process. In the basic configuration of the cover member 100, as shown in FIGS. 13 and 14, the cover member has: a tubular portion 101 into which the driving shaft 63 is fitted; a flange-like portion 102 which is disposed in a flange like manner in the periphery of the tubular portion 101; and a to-be-fitted portion 103 which is annularly projected from the periphery of the flange-like portion 102, and which is fitted to an end portion of the photosensitive drum 60.

The outer circumference of the to-be-fitted portion 103 is stepped, and has: a to-be-fitted face 111 which is interference-fitted to the inner circumferential surface of the photosensitive drum 60; an adhesive agent applying surface 112 which is adjacent to the tip end side of the to-be-fitted face 111 to be smaller in diameter than the to-be-fitted face 111, and to which an adhesive agent is to be applied; and a guide surface 113 which is adjacent to the tip end side of the adhesive agent applying surface 112 to be smaller in diameter than the adhesive agent applying surface 112.

The adhesive agent applying surface 112 is configured so that a gap of about 0.05 mm is ensured with respect to the inner circumferential surface of the photosensitive drum 60.

Figure 16:
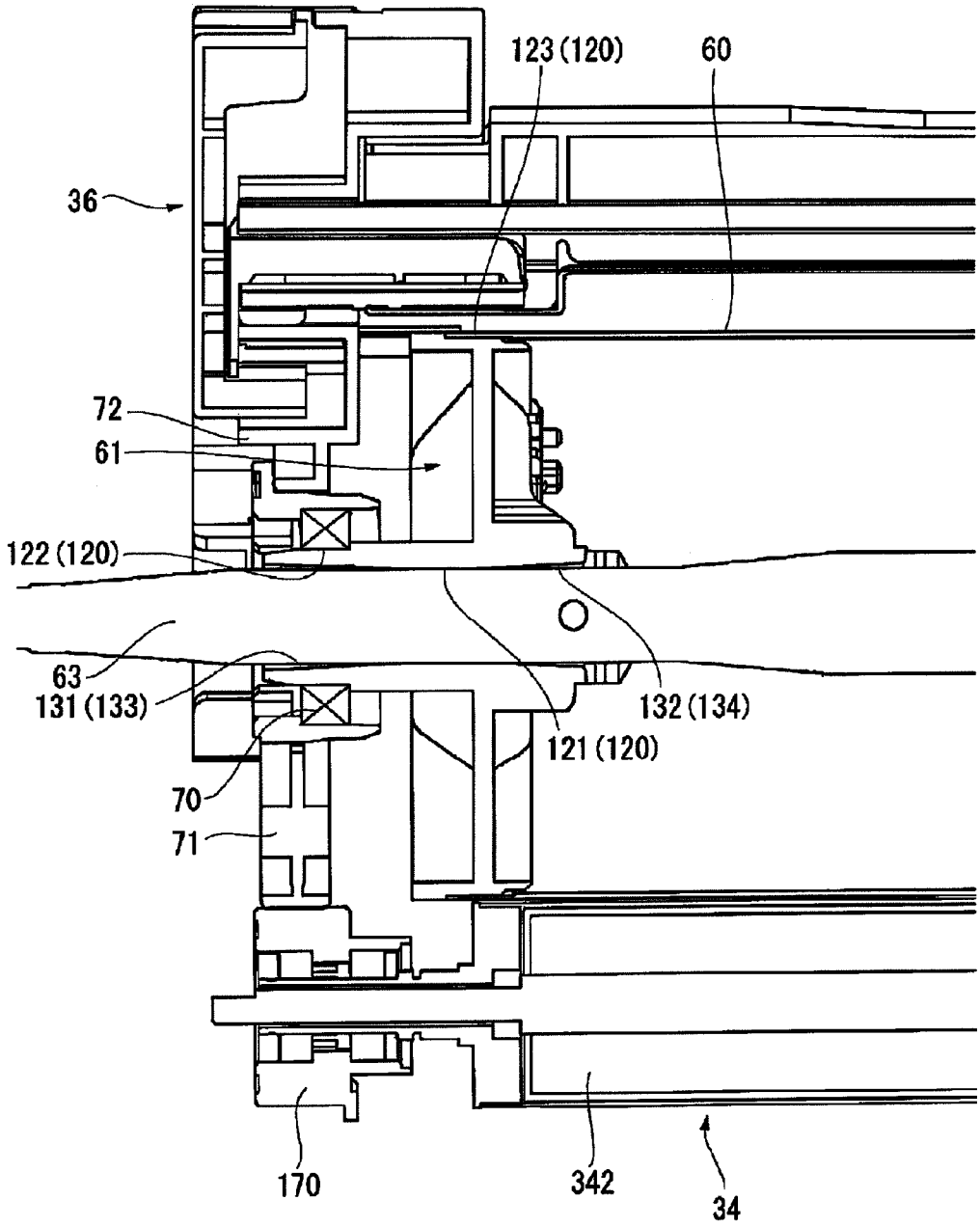
FIG. 16 is a diagram showing an example of a positioning structure between an end of the photosensitive member used in Exemplary embodiment 1 and the developing device.
Figure 17:
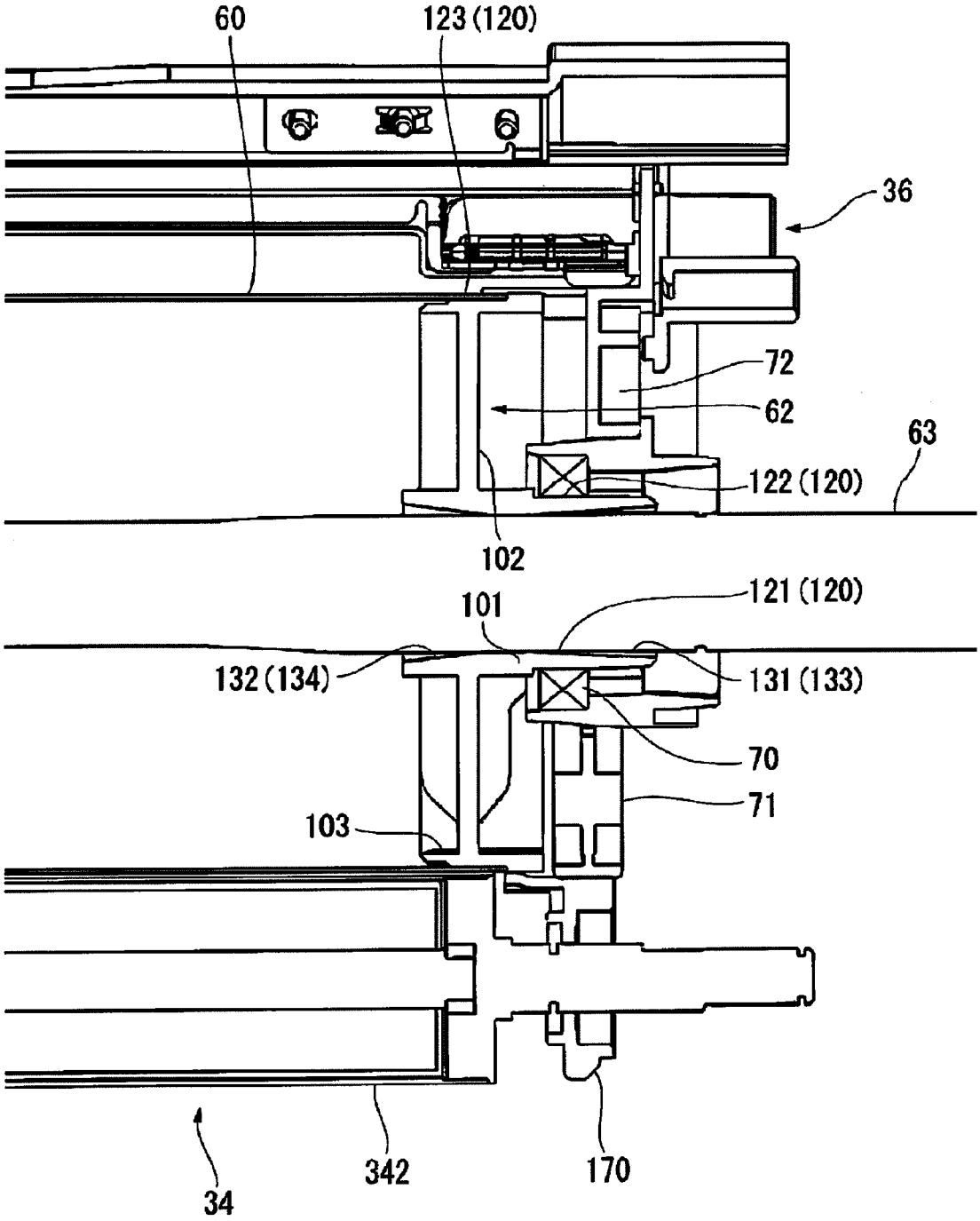
FIG. 17 is a diagram showing an example of a positioning structure between the other end of the photosensitive member used in Exemplary embodiment 1 and the developing device.

In the exemplary embodiment, as shown in FIGS. 16 and 17, a cut surface 120 (specifically, 121 and 122) is annularly formed on each of the inner and outer circumferences of the tubular portions 101 of the flanges 61, 62, and the to-be-fitted face 111 on each of the outer circumferences of the to-be-fitted portions 103 is formed as a cut surface 120 (specifically, 123).

On each of the inner circumferences of the tubular portions 101 of the flanges 61, 62, recesses 131, 132 are disposed across the cut surface 121 so that gaps are formed between the inner circumference and the driving shaft 63. The recesses 131, 132 are formed as inclined portions 133, 134 in each of which the inner circumferential section shape of the tubular portion 101 is expanded as advancing toward the corresponding end of the tubular portion 101.

On the other hand, the flange 61 (as required, referred to as the front flange) which is located in the front side of the image forming apparatus, and the flange 62 ((as required, referred to as the rear flange) which is located in the rear side are configured in slightly different manners.

Figure 13B:
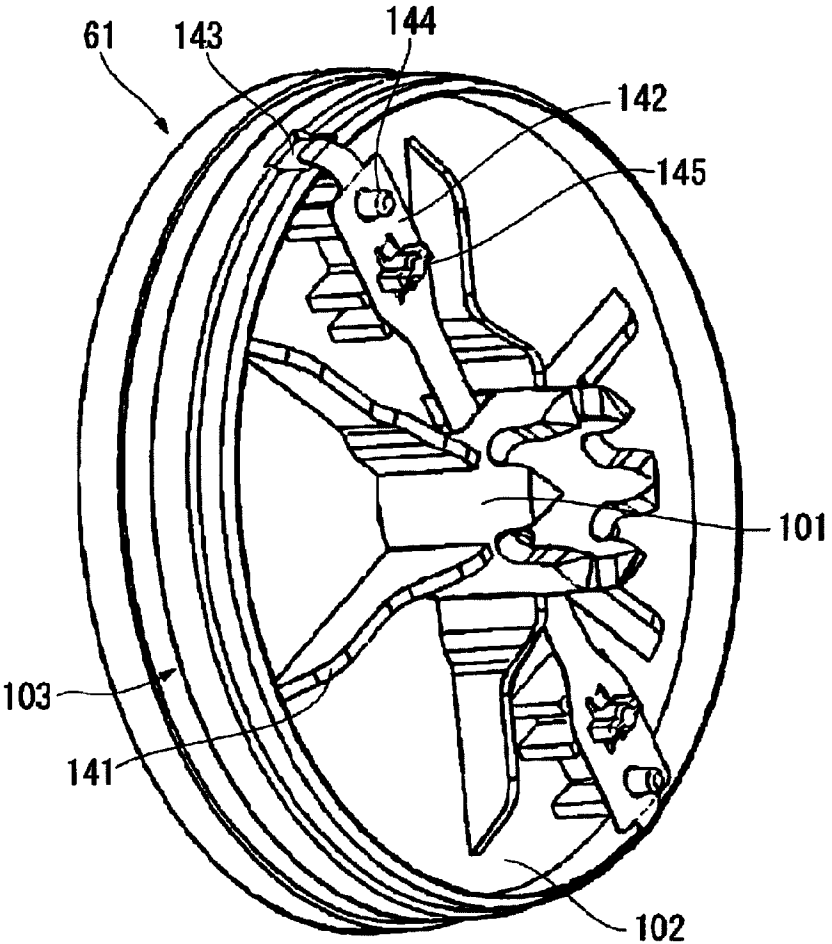
FIG. 13B is a perspective diagram of the flange of FIG. 13A as viewed from the rear side.
Figure 13A:
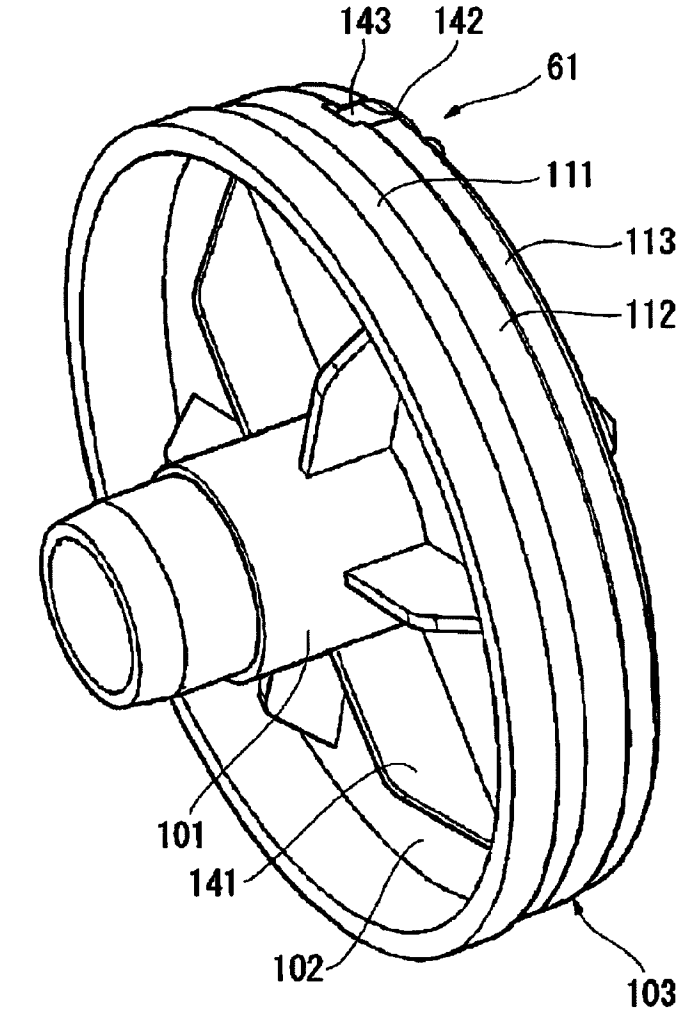
FIG. 13A is a perspective diagram of one flange of the photosensitive member as viewed from the front side.

In the front flange 61 in the exemplary embodiment, as shown in FIGS. 12B, 13A, and 13B, a plurality (in the exemplary embodiment, six) of reinforcement ribs 141 which radially extend from the tubular portion 101 are disposed on the front and rear surfaces of the flange-like portion 102 between the tubular portion 101 and the to-be-fitted portion 103. Furthermore, for example, a pair of electrically conductive plate springs 142 which is used for grounding the photosensitive drum 60, and which is made of, for example, stainless steel are placed in the rear side of the flange-like portion 102. An engaging recess 143 for one end of each of the electrically conductive plate springs 142 is formed in a tip end portion of the to-be-fitted portion 103, and holding portions 144, 145 which can engagingly hold the electrically conductive plate spring 142 are formed in the rear side of the flange-like portion 102, so that the other end of the electrically conductive plate spring 142 is contactingly placed on the driving shaft 63.

Figure 14B:
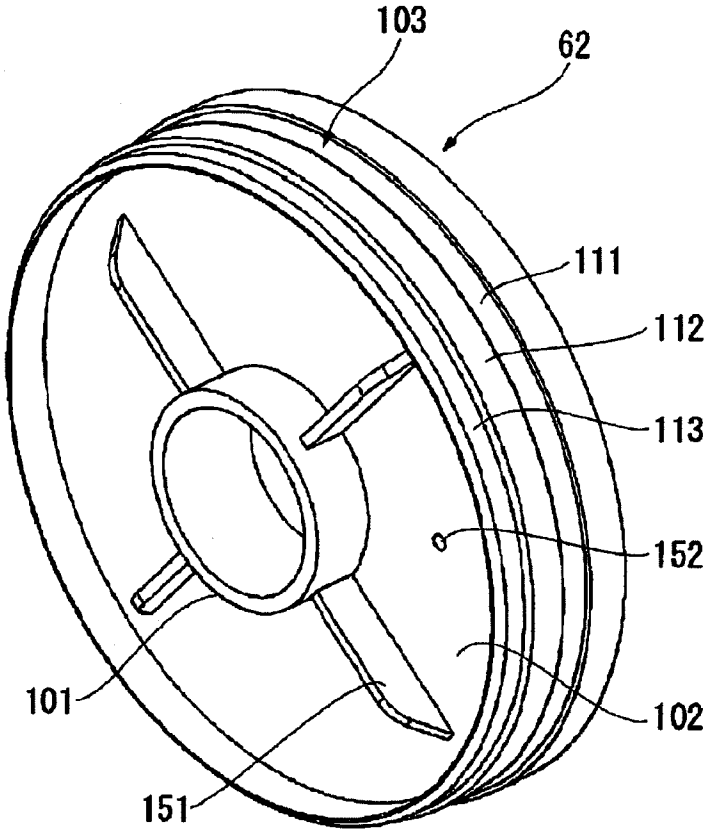
FIG. 14B is a perspective diagram of the flange of FIG. 14A as viewed from the rear side.
Figure 14A:
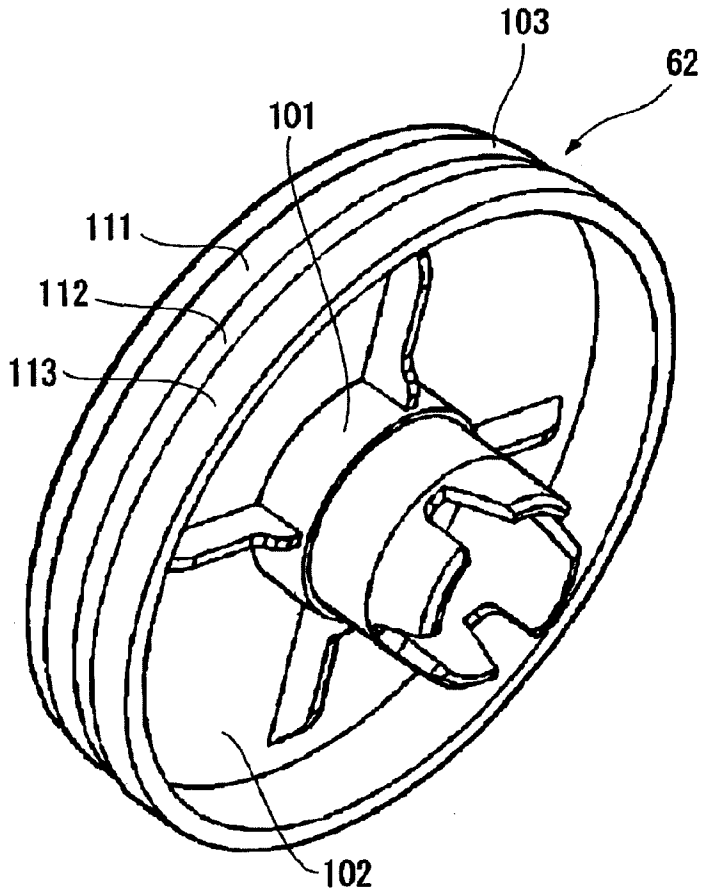
FIG. 14A is a perspective diagram of another flange of the photosensitive member as viewed from the front side.

By contrast, in the rear flange 62, as shown in FIGS. 12C, 14A, and 14B, a plurality (in the exemplary embodiment, four) of reinforcement ribs 151 which radially extend from the tubular portion 101 are disposed on the front and rear surfaces of the flange-like portion 102 between the tubular portion 101 and the to-be-fitted portion 103, and an air vent hole 152 which is to be used in die molding is disposed in a part of the flange-like portion 102.

<Developing Assembly>

Figure 15:
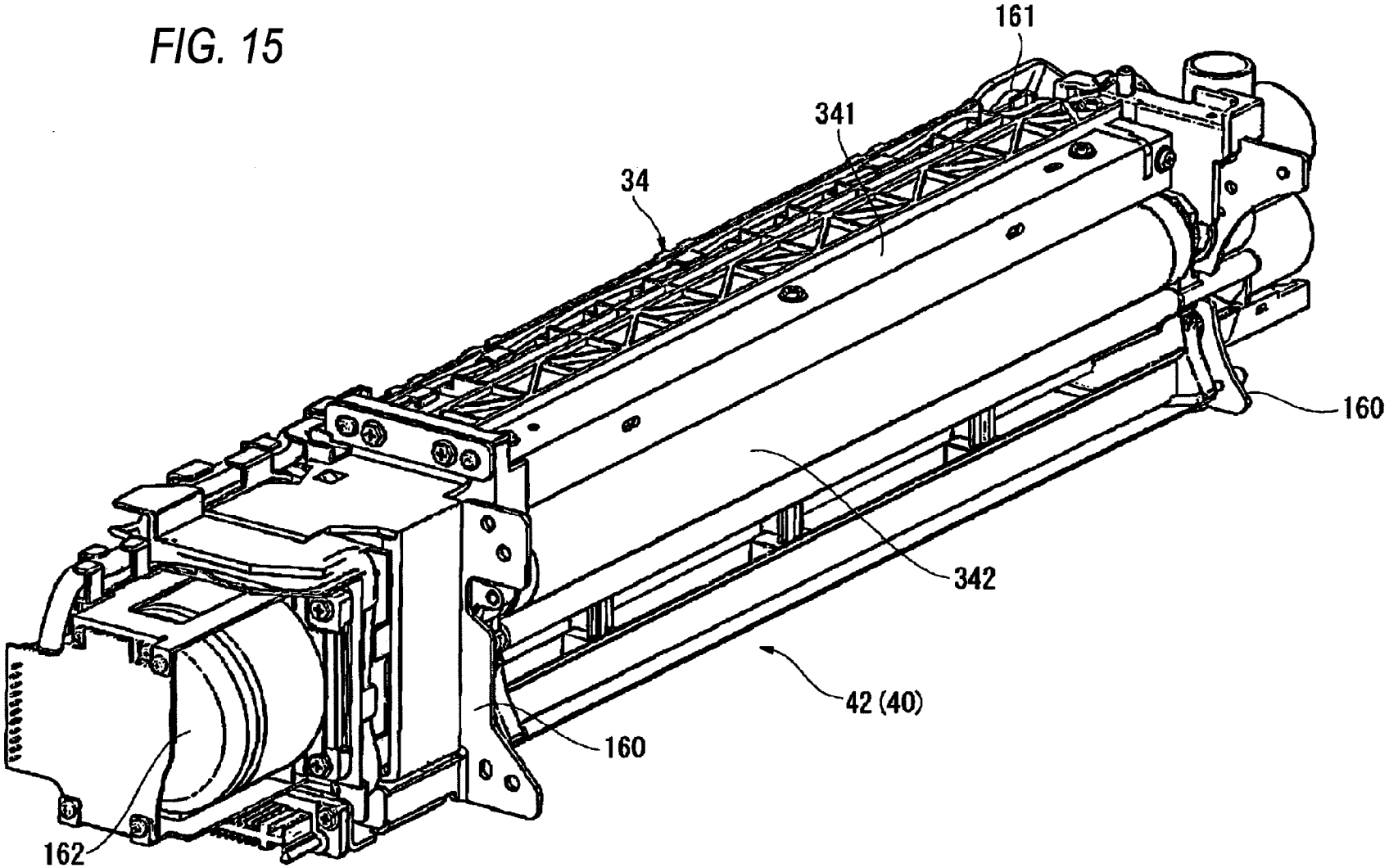
FIG. 15 is a perspective diagram showing main portions of the developing assembly used in Exemplary embodiment 1.

In the exemplary embodiment, as shown in FIGS. 5 and 15, the developing assembly 42 is fixed to the supporting frame 50 of the photosensitive member assembly 41 through fixing members 160, but the developing container 341 of the developing device 34 is supported so as to be swingable with respect to the fixing members 160, and pressed toward the photosensitive member 31 by a press spring (not shown). The reference numeral 161 denotes a press spring housing portion which houses the press spring. Although hidden in the figures, a functional portion which is similar to the press spring housing portion is disposed in the left side of the developing assembly 42 in the figures.

The reference numeral 162 denotes a driving motor which drives the developing roll 342, etc.

In the developing device 34 in the exemplary embodiment, as shown in FIGS. 16 and 17, to-be-positioned rolls 170 which are coaxial with the developing roll 342 are disposed in the both ends of the developing roll 342, so that the rolls butt against the projecting pieces 712 of the developing positioning members 71 on the side of the photosensitive member assembly 41, respectively.

Figure 18:
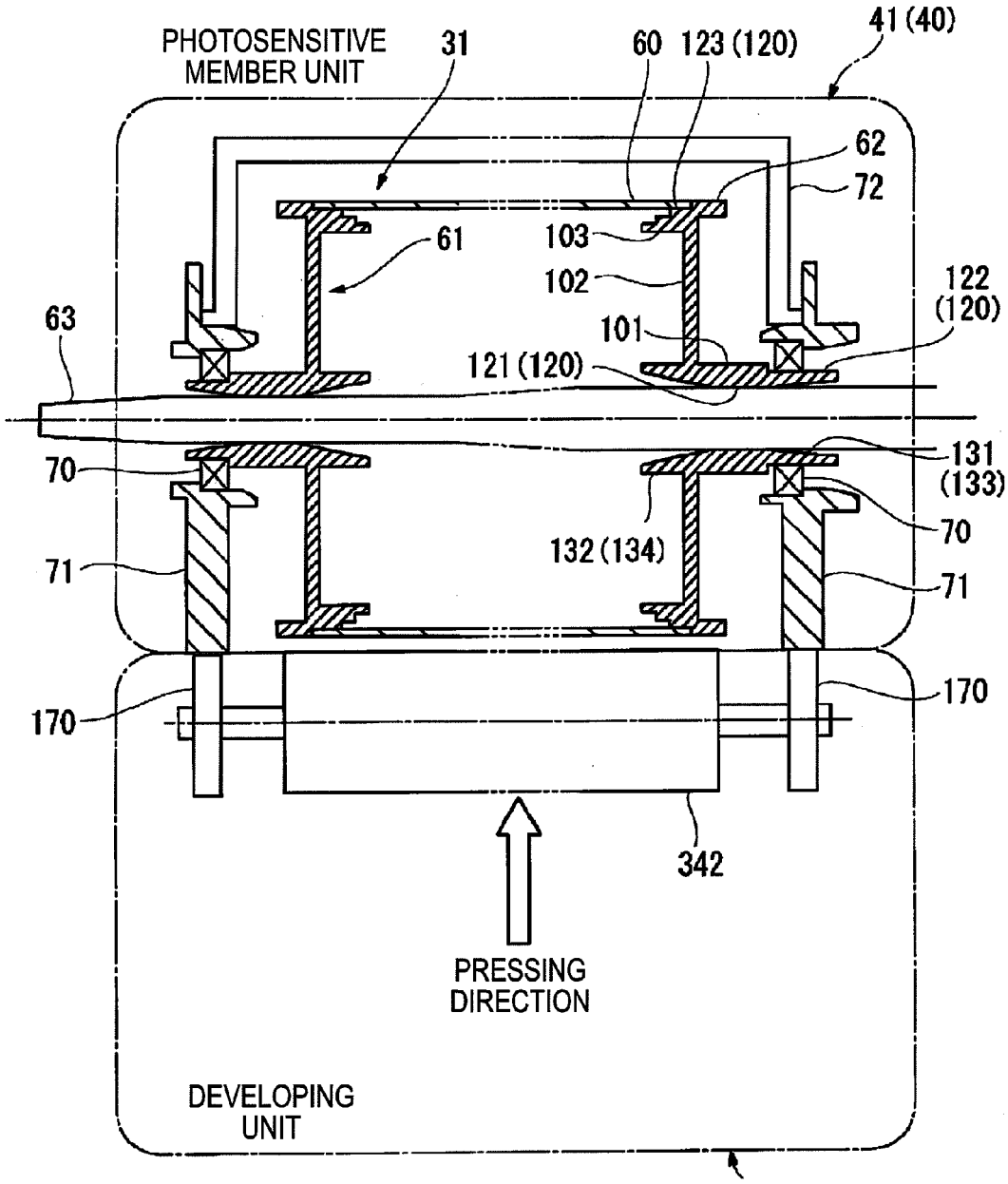
FIG. 18 is a diagram schematically showing positional relationships between the photosensitive member assembly (photosensitive member unit) and the developing assembly (developing unit) in Exemplary embodiment 1.

Next, the configuration of the vicinity of the photosensitive member 31 in the image forming apparatus of the exemplary embodiment is schematically shown in FIG. 18.

Referring to the figure, the rotary wobbling motion of the photosensitive member 31 is very small, so that rotation of the photosensitive member 31 is stabilized, and the relative position between the photosensitive member 31 and a peripheral functional member (for example, the developing device 34 or the charging device 32) is accurately maintained.

This mainly depends on the configurations of the flanges 61, 62. In the exemplary embodiment, the flanges 61, 62 can be obtained by the production method shown in FIGS. 19A and 19B.

—Method of Producing Flange—

Figure 19B:
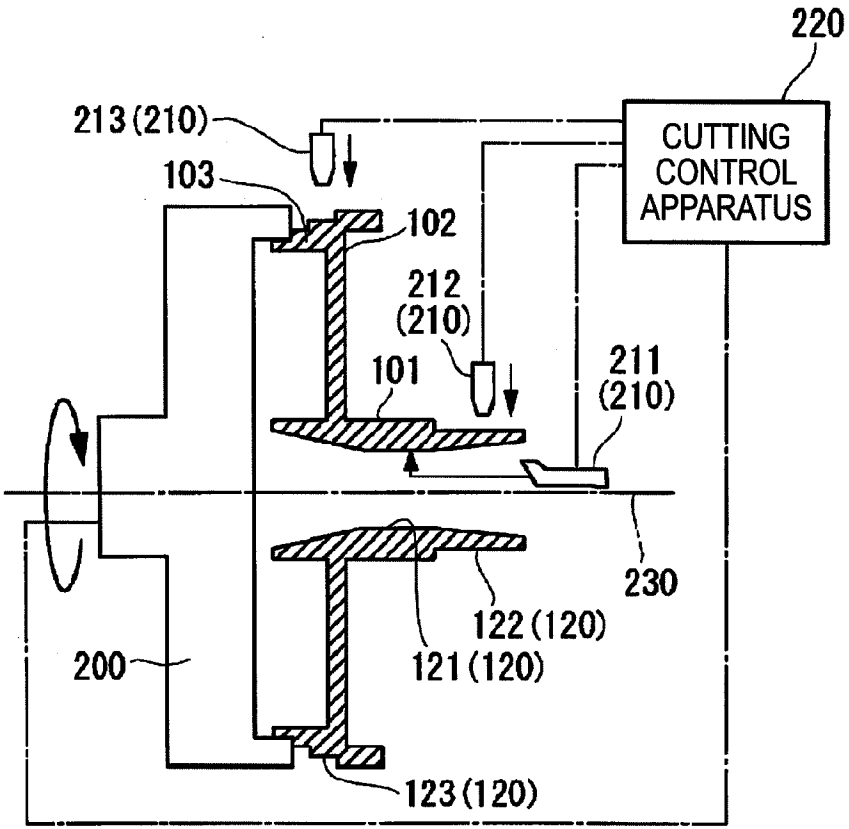
FIG. 19B is a diagram showing production step II (cutting process) of the end cover part.
Figure 19A:
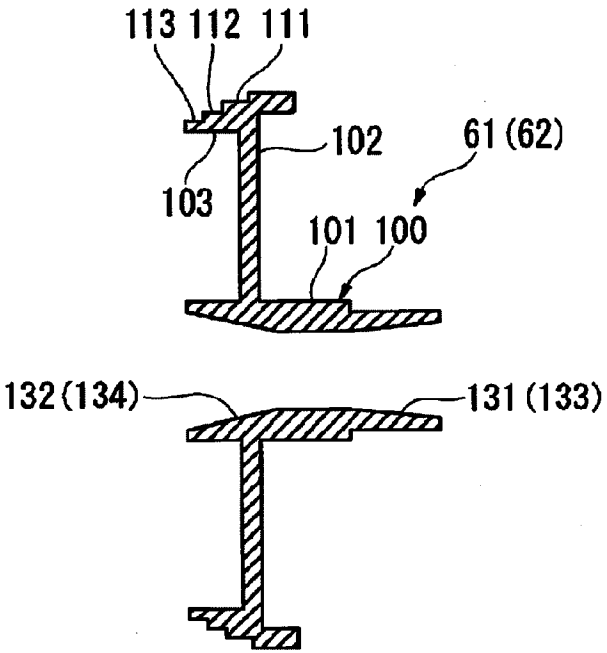
FIG. 19A is a diagram showing production step I (die molding) of the end cover part of the photosensitive member.

Production Step I:

As shown in FIG. 19A, first, the flanges 61, 62 are primarily processed by the die molding.

At this time, the basic shapes of the flanges 61, 62 are obtained as the cover member 100 having the tubular portion 101, the flange-like portion 102, and the to-be-fitted portion 103.

Production Step II:

The cover members 100 of the flanges 61, 62 which have undergone Production step I are subjected to a cutting process as Production step II as shown in FIG. 19B.

At this time, Production step II may be performed in the following manner. The cover member 100 is grasped by a grasping jig 200 such as a chuck so as to be rotatable about a common reference central axis 230. On the inner and outer circumferences of the tubular portion 101 of the cover member 100, and the to-be-fitted face 111 on the outer circumference of the to-be-fitted portion 103, thereafter, the cut surfaces 120 (specifically, 121 to 123) are sequentially formed by cutting tools 210 (specifically, 211 to 213) such as bites. The reference numeral 220 denotes a cutting control apparatus which controls driving of the grasping jig 200 and the cutting tools 210.

—Performance of Flange—

Figure 20:
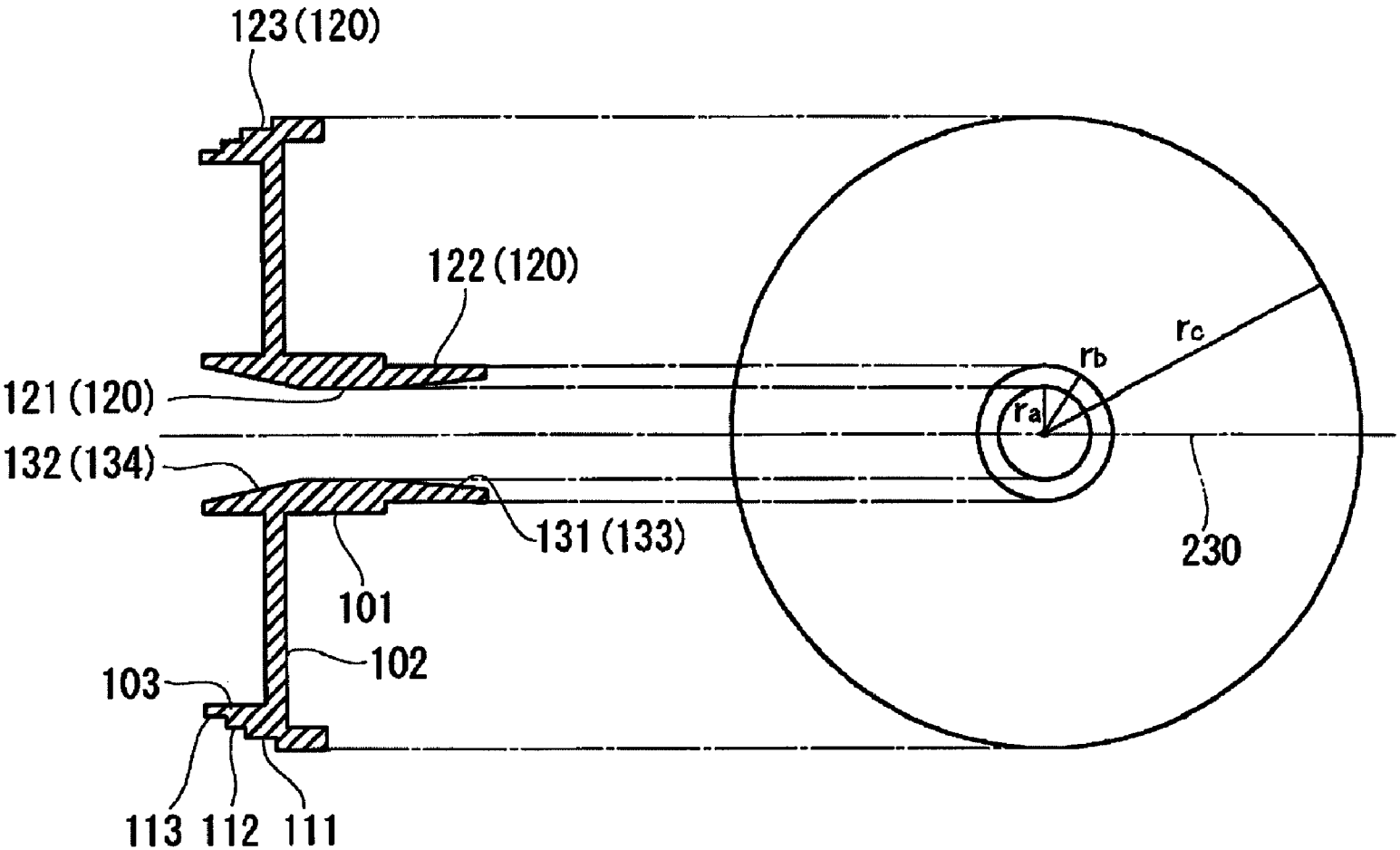
FIG. 20 is a diagram showing the dimensional accuracy of the end cover part which is produced in the production steps shown in FIGS. 19A and 19B.

The flanges 61, 62 which are obtained by the above-described method have the performance such as shown in FIG. 20.

Referring to the figure, the inner and outer circumferences of the tubular portion 101 of the cover member 100, and the to-be-fitted face 111 on the outer circumference of the to-be-fitted portion 103 are formed as the concentric cut surfaces 120 (specifically, 121 to 123) which are centered at the common reference central axis 230, and which have radii ra, rb, and rc, respectively. Therefore, they exert the following effects.

First, the cut surfaces 121 (120) of the inner circumferences of the tubular portions 101 and the driving shaft 63 are clearance-fitted to each other through the gap lengths O, respectively.

Second, the cut surfaces 122 (120) of the outer circumferences of the tubular portions 101 and the bearing members 70 are clearance-fitted to each other through the gap lengths O, and the developing positioning members 71 are contactingly placed in the rotation locked state on the bearing members 70, and butt against the to-be-positioned rolls 170 on the side of the developing device 34, respectively. While using the cut surfaces 122 as a positioning reference plane, therefore, the developing roll 342 of the developing device 34 is accurately positioned through the bearing members 70, the developing positioning members 71, and the to-be-positioned rolls 170, so that the distance between the developing roll 342 and the photosensitive member 31 is accurately maintained.

Third, the grid electrode 323 of the charging device 32 is positioned while the to-be-positioned portions 325 serving as the end supporting portions of the electrode butt against the positioning protrusions 81 to 83 of the case members 72. At this time, the case members 72 are attached in the rotation locked state to the peripheries of the annular portions 711 of the developing positioning members 71 through the substantially C-like receiving portions 721, respectively. While using the cut surfaces 122 (120) of the outer circumferences of the tubular portions 101 as a positioning reference plane, therefore, the grid electrode 323 of the charging device 32 is accurately positioned through the bearing members 70, the developing positioning members 71, the positioning protrusions 81 to 83 of the case members 72, and the to-be-positioned portions 325 serving as the end supporting portions of the grid electrode 323 of the charging device 32.

Fourth, the photosensitive drum 60 is interference-fitted to the cut surfaces 123 (120) which are the to-be-fitted faces 111 of the to-be-fitted portions 103 of the flanges 61, 62, and hence the photosensitive drum 60 is accurately rotated in accordance with the roundnesses of the cut surfaces 123 (120) of the flanges 61, 62.

Fifth, in the cleaning device 36 of the photosensitive member assembly 41, the plate-like cleaning member 362 is pressed against the photosensitive member 31. Even when the photosensitive member 31 is incorporated in a state where rattling may be caused in the photosensitive member assembly 41, therefore, the photosensitive member 31 is shifted to one side by the plate-like cleaning member 362, and hence backlash of the photosensitive member 31 due to the rattling is effectively suppressed.

—Shape of Flange in Die Molding—

Figure 21:
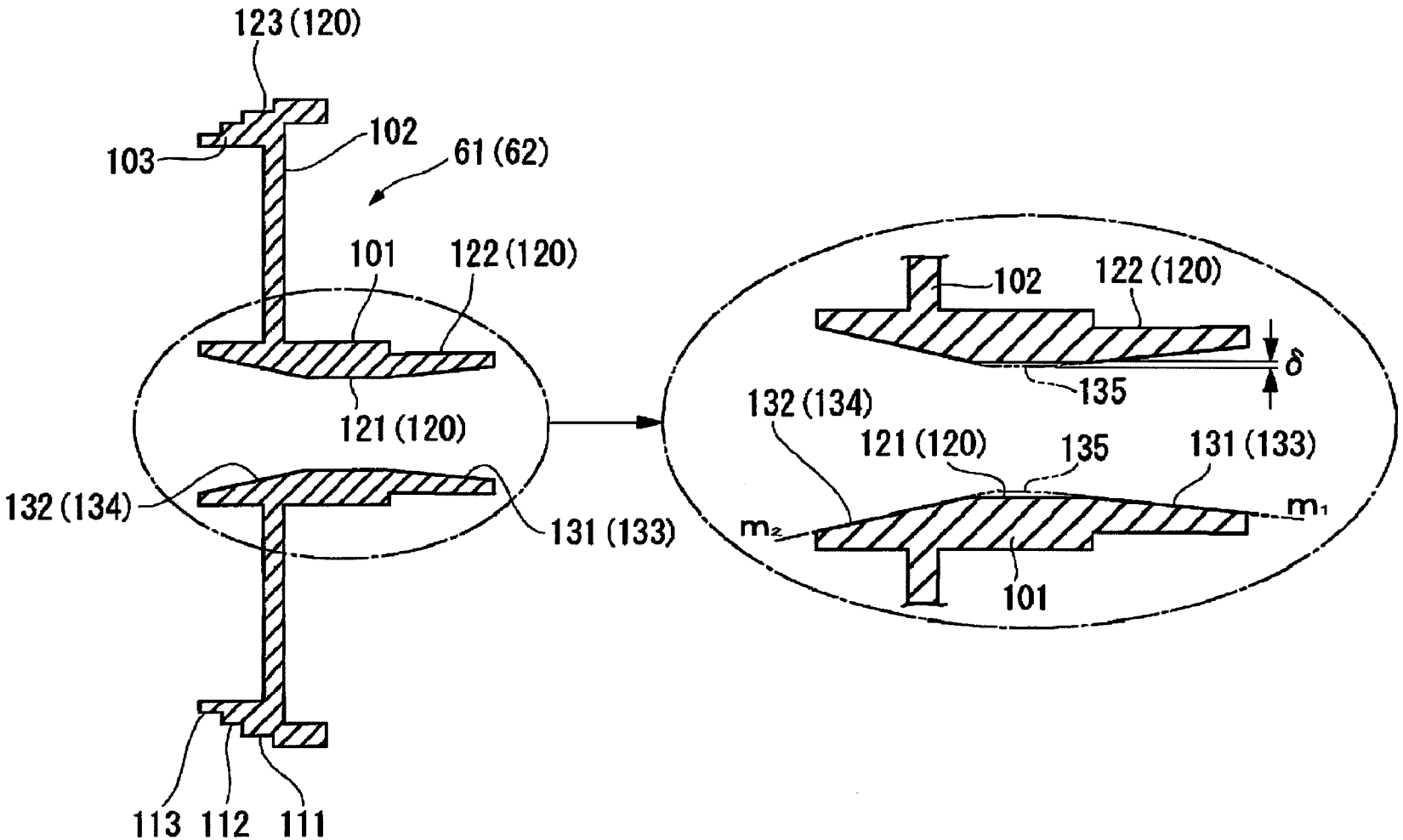
FIG. 21 is a diagram showing the shape of the end cover part which has been undergone the die molding, and has not yet been undergone the cutting process.

In the flanges 61, 62 in the exemplary embodiment, as shown in FIG. 21, the inclined portions 133, 134 are formed as the recesses 131, 132 on the inner circumferences of the tubular portions 101.

The recesses 131, 132 are obtained by secondarily processing the cut surfaces 123 (120) on the inner circumferences of the tubular portions 101. Before the secondary process of the cut surfaces 123 (120), however, it is necessary to select a shape in which a cutting process length δ is considered, as the shapes of the flanges 61, 62 in the die molding.

In the exemplary embodiment, as shown in FIG. 21, a trapezoidal sectional shape region 135 in which inclined lines $m_1$, $m_2$ of the inclined portions 133, 134 of the recesses 131, 132 are extended is ensured by the degree corresponding to the cutting process length δ.

According to the configuration, even when the cut surfaces 123 (120) is secondarily processed, there arises no possibility that a level difference remains in the interfaces between the cut surfaces 123 (120) and the inclined portions 133, 134 of the recesses 131, 132.

By contrast, in the case where a rectangular sectional shape region is ensured by the degree corresponding to the cutting process length δ, for example, there is a possibility that, when the cutting process length δ is smaller than a specified value, a level difference is produced between the cut surfaces 123 (120) and the inclined portions 133, 134 of the recesses 131, 132.

—Placement Position of Recess—

Figure 22:
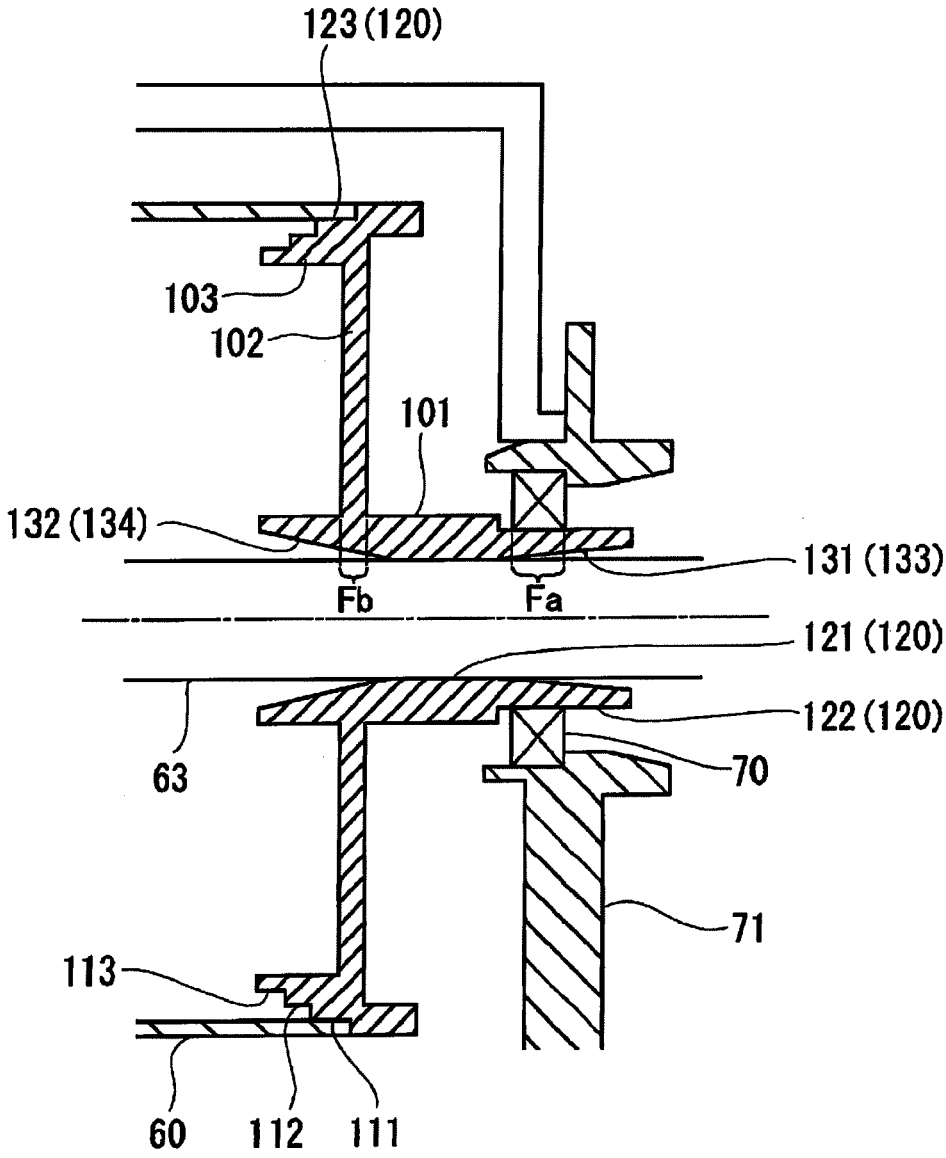
FIG. 22 is a diagram showing the function of a recess of the perspective view used in Exemplary embodiment 1.

In the exemplary embodiment, as shown in FIG. 22, the recesses 131, 132 are ensured across the cut surface 123 (120) on the inner circumference of the tubular portion 101 of each of the flanges 61, 62.

In the exemplary embodiment, it is preferred that the recesses 131, 132 are disposed correspondingly with portions of the flanges 61, 62 on which external forces act from the radially outer side of the tubular portions 101.

In the exemplary embodiment, regions Fa corresponding to the bearing members 70 on which external forces act from the radially outer side of the tubular portions 101 are handled as external-force acting portions. Preferably, the recesses 131 are disposed so as to include the regions Fa corresponding to the bearing members 70.

In this case, even when an excessive radial load from the developing device 34 acts on the tubular portions 101 of the flanges 61, 62 through the to-be-positioned rolls 170, the developing positioning members 71, and the bearing members 70, for example, an external force due to the radial load is absorbed by the recesses 131 to be little transmitted to the driving shaft 63.

Furthermore, even when an excessive radial load from the charging device 32 acts on the tubular portions 101 of the flanges 61, 62 through the case members 72, the developing positioning members 71, and the bearing members 70, a situation similar to the above occurs.

Also portions of the tubular portions 101 which are coupled with the flange-like portions 102 are portions on which external forces act from the radially outer side of the tubular portions 101. In order to reduce the influences of the external forces from the portions of the tubular portions 101 which are coupled with the flange-like portions 102, therefore, it is preferred that the recesses 132 are disposed so as to include regions Fb corresponding to engaged portions of the tubular portions 101.

In this case, when it is assumed that the plate-like cleaning member 362 of the cleaning device 36 strongly butts against the photosensitive member 31, for example, there is a possibility that an excessive radial load from the to-be-fitted portions 103 of the flanges 61, 62 acts on the portions coupled with the tubular portions 101 through the flange-like portions 102. However, an external force due to the radial load is absorbed by the recesses 132 to be little transmitted to the driving shaft 63.

Although, in the exemplary embodiment, the recesses 131, 132 are disposed correspondingly with the whole region of the portions of the flanges 61, 62 on which external forces act from the radially outer side of the tubular portions 101, the recesses are not required to be disposed in the whole region.

—Assembling of Photosensitive Member—

In the case where the photosensitive member 31 is to be assembled, the adhesive agent is applied to the flanges 61, 62, and then the flanges are interference-fitted to the both ends of the photosensitive drum 60.

At this time, since the cut surfaces 120 (specifically, 121 to 123) of the flanges 61, 62 have an accurate roundness, it is not necessary to largely consider the relative positional relationships between the flanges 61, 62 in the both ends of the photosensitive drum 60.

Even when a cutting process based on the common reference central axis 230 is applied to the three places of each of the flanges 61, 62, however, the roundnesses of the flanges 61, 62 may include a small eccentric component depending on the processing accuracy of an apparatus for performing the cutting process.

Figure 23A:
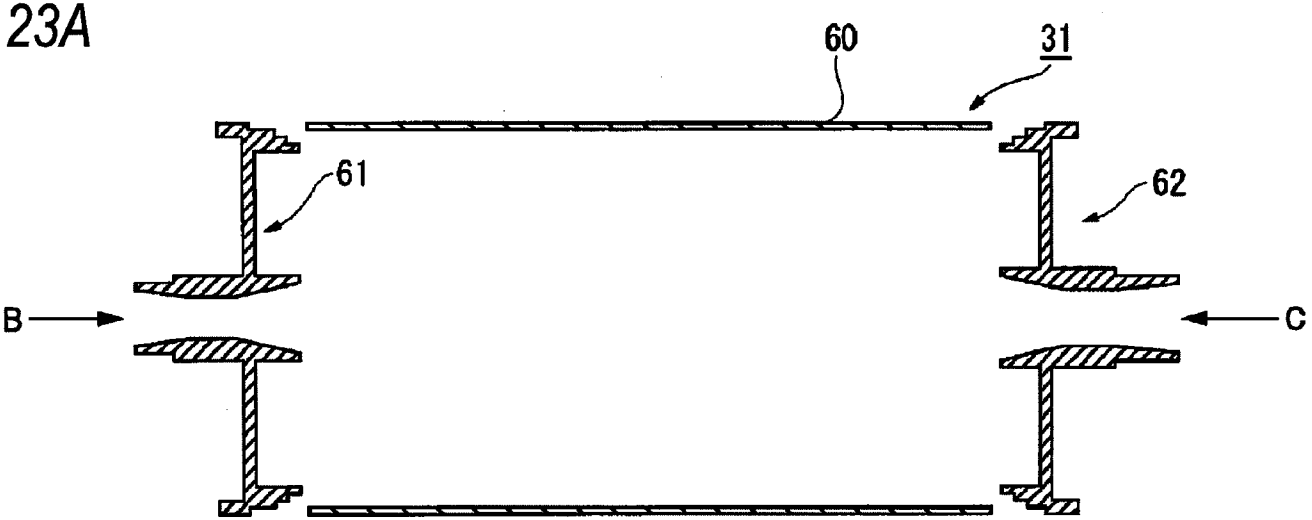
FIG. 23A is a diagram showing a method of assembling the photosensitive member.
Figure 23B:
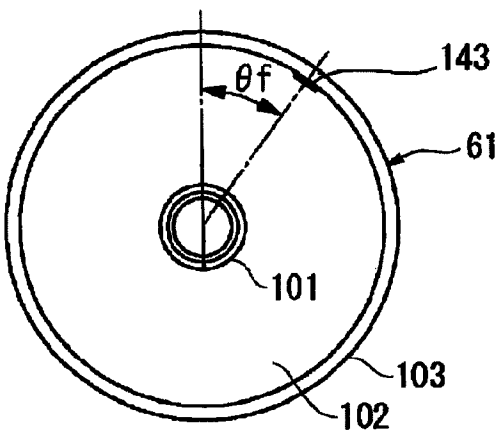
FIG. 23B is a view looking in the direction of the arrow B in FIG. 23A.
Figure 23C:
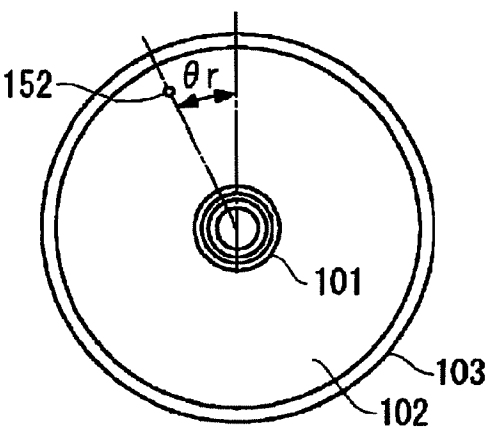
FIG. 23C is a view looking in the direction of the arrow C in FIG. 23A.

In such a case, as shown in FIGS. 23A and 23B, for example, the both ends of the photosensitive drum 60 are closed by the flanges 61, 62 with an angular relationship in which the eccentricity amount in the rotation of the photosensitive drum 60 with respect to the reference position is not increased.

In the exemplary embodiment, at this time, in the front flange 61, for example, the engaging recesses 143 for the electrically conductive plate springs 142 function as an index with respect to the reference position, and, in the rear flange 62, the air vent hole 152 functions as an index with respect to the reference position. As the angular relationship in which the eccentricity amount in the rotation of the photosensitive drum 60 is not increased, therefore, an angular relationship in which the index is positioned at θf with respect to the reference position is selected in the front flange 61, and that in which the index is positioned at θr with respect to the reference position is selected in the rear flange 62.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An end cover part which is used to close an end of a cylindrical body, and transmits a driving force of a rotatable driving shaft to the cylindrical body, the end cover part comprising:

a cover member having a tubular portion into which the driving shaft is to be fitted, and a to-be-fitted portion which is disposed in a flange-like manner in a periphery of the tubular portion, and which is to be fitted into an end portion of the cylindrical body;

cut surfaces which are disposed respectively on an inner circumference of the tubular portion of the cover member and an outer circumference of the to-be-fitted portion and concentrically about a common reference central axis; and a recess which is disposed so as to ensure a gap between the inner circumference of the tubular portion and the driving shaft in a place of the inner circumference of the tubular portion adjacent to the cut surface of the inner circumference and corresponding to a portion on which an external force acts from the radially outer side of the tubular portion on an outer circumference of the tubular portion, wherein the recess is formed as an inclined portion in which an inner circumferential section shape of the tubular portion is expanded as advancing toward an end of the tubular portion.

2. The end cover part according to claim 1, wherein a cut surface centered at the common reference central axis is disposed also on the outer circumference of the tubular portion, the cut surface is used as a positioning reference plane for positioning a functional member which is disposed in a periphery of the cylindrical body, and the recess is disposed on the inner circumference of the tubular portion corresponding to the portion of the cut surface on which the external force acts from the radially outer side of the tubular portion, the cut surface being used as the positioning reference plane.

3. The end cover part according to claim 2, wherein the recess is disposed on the inner circumference of the tubular portion corresponding to a portion of the cover member where is a portion on which an external force acts from the radially outer side of the tubular portion, and where the to-be-fitted portion and the tubular portion are coupled with each other.

4. The end cover part according to claim 2, wherein the recess is formed as an inclined portion in which an inner circumferential section shape of the tubular portion is expanded as advancing toward an end of the tubular portion.

5. The end cover part according to claim 1, wherein the recess is disposed on the inner circumference of the tubular portion corresponding to a portion of the cover member where is a portion on which an external force acts from the radially outer side of the tubular portion, and where the to-be-fitted portion and the tubular portion are coupled with each other.

6. The end cover part according to claim 5, wherein the recess is formed as an inclined portion in which an inner circumferential section shape of the tubular portion is expanded as advancing toward an end of the tubular portion.

7. The end cover part according to claim 1, wherein the recess is disposed on the inner circumference of the tubular portion corresponding to the whole region of the portion of the outer circumference of the tubular portion on which the external force acts from the radially outer side.

8. The end cover part according to claim 1, wherein the cover member is configured by a glass fiber filled synthetic resin.

9. A method of producing the end cover part according to claim 1, comprising, in the following order: die-molding the cover member so that the recess is formed in a predetermined portion of the inner circumference of the tubular portion, grasping the die-molded cover member by a grasping jig to be rotatable about the common reference central axis, and sequentially forming the cut surfaces by cutting tools on the place where the cut surfaces are to be formed, and where the inner circumference of the tubular portion of the cover member and the outer circumference of the to-be-fitted portion are included.

10. An image carrier comprising: a cylindrical body which is able to hold an image; and an end cover part which closes an end of the cylindrical body, and transmits a driving force of a rotatable driving shaft to the cylindrical body, the end cover part comprising: a cover member having a tubular portion into which the driving shaft is fitted, and a to-be-fitted portion which is disposed in a flange-like manner in a periphery of the tubular portion, and which is fitted into an end portion of the cylindrical body; cut surfaces which are disposed respectively on an inner circumference of the tubular portion of the cover member, and an outer circumference of the to-be-fitted portion, and concentrically about a common reference central axis; and a recess which is disposed so as to ensure a gap between the inner circumference of the tubular portion and the driving shaft in a place of the inner circumference of the tubular portion adjacent to the cut surface of the inner circumference and corresponding to a portion on which an external force acts from the radially outer side of the tubular portion on an outer circumference of the tubular portion, wherein the recess is formed as an inclined portion in which an inner circumferential section shape of the tubular portion is expanded as advancing toward an end of the tubular portion.

11. An image forming assembly wherein the assembly comprises at least the image carrier according to claim 10 and an image forming device which visualizes an image held on the image carrier, by means of a powder, and the image carrier and the image forming device are incorporated in a common case member.

12. The image forming assembly according to claim 11, wherein the image forming device is pressed toward the image carrier, and uses the cut surface disposed on the outer circumference of the tubular portion of the end cover part, as a positioning reference plane, a positioning member is disposed through a bearing member with respect to the positioning reference plane on a side of the end cover part, and a to-be-positioned member which butts against the positioning member is disposed on a side of the image forming device.

13. An image forming apparatus comprising at least: the image carrier according to claim 10; and an image forming device which visualizes an image held on the image carrier, by means of a powder.

14. The image forming apparatus according to claim 13, wherein, in the image carrier and the image forming device, the cut surface disposed on the outer circumference of the tubular portion of the end cover part is used as a positioning reference plane, a positioning member is disposed through a bearing member on the positioning reference plane on a side of the end cover part, and a to-be-positioned member which butts against the positioning member is disposed on a side of the image forming device.

15. The image forming apparatus according to claim 13, wherein the apparatus comprises a cleaning device which cleans the image carrier, and the cleaning device has a plate-like cleaning member which is pressingly contacted with the image carrier.

* * * * *